US010934609B2

(12) United States Patent
Toda et al.

(10) Patent No.: US 10,934,609 B2
(45) Date of Patent: Mar. 2, 2021

(54) STEEL SHEET FOR CARBURIZING, AND METHOD FOR MANUFACTURING STEEL SHEET FOR CARBURIZING

(71) Applicant: NIPPON STEEL CORPORATION, Tokyo (JP)

(72) Inventors: Yuri Toda, Tokyo (JP); Kazuo Hikida, Tokyo (JP); Motonori Hashimoto, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 16/346,461

(22) PCT Filed: Aug. 30, 2018

(86) PCT No.: PCT/JP2018/032111
§ 371 (c)(1),
(2) Date: Apr. 30, 2019

(87) PCT Pub. No.: WO2019/044970
PCT Pub. Date: Mar. 7, 2019

(65) Prior Publication Data

US 2020/0181744 A1 Jun. 11, 2020

(30) Foreign Application Priority Data

Aug. 31, 2017 (JP) ..... JP2017-167204

(51) Int. Cl.

| | |
|---|---|
| ***C22C 38/04*** | (2006.01) |
| ***C21D 1/32*** | (2006.01) |
| ***C21D 8/02*** | (2006.01) |
| ***C21D 9/46*** | (2006.01) |
| ***C22C 38/00*** | (2006.01) |
| ***C22C 38/02*** | (2006.01) |
| ***C22C 38/06*** | (2006.01) |
| ***C22C 38/08*** | (2006.01) |
| ***C22C 38/10*** | (2006.01) |
| ***C22C 38/12*** | (2006.01) |
| ***C22C 38/14*** | (2006.01) |
| ***C22C 38/16*** | (2006.01) |
| ***C22C 38/32*** | (2006.01) |
| ***C23C 8/22*** | (2006.01) |

(52) U.S. Cl.
CPC ..... *C22C 38/04* (2013.01); *C21D 1/32* (2013.01); *C21D 8/0226* (2013.01); *C21D 8/0236* (2013.01); *C21D 8/0263* (2013.01); *C21D 8/0273* (2013.01); *C21D 9/46* (2013.01); *C22C 38/001* (2013.01); *C22C 38/005* (2013.01); *C22C 38/02* (2013.01); *C22C 38/06* (2013.01); *C22C 38/08* (2013.01); *C22C 38/10* (2013.01); *C22C 38/12* (2013.01); *C22C 38/14* (2013.01); *C22C 38/16* (2013.01); *C22C 38/32* (2013.01); *C23C 8/22* (2013.01); *C21D 2211/005* (2013.01)

(58) Field of Classification Search
CPC ..... C21D 8/0226; C21D 8/0236; C21D 1/32; C21D 8/0263; C21D 8/0273; C22C 38/04
See application file for complete search history.

(56) References Cited

U.S. PATENT DOCUMENTS

2003/0196735 A1* 10/2003 Sugiura ..... C22C 38/02 148/602

FOREIGN PATENT DOCUMENTS

| | | | |
|---|---|---|---|
| CN | 102712982 | A | 10/2012 |
| CN | 104726768 | A | 6/2015 |
| JP | 3094856 | B2 | 10/2000 |
| JP | 2015-160986 | A | 9/2015 |
| JP | 2016-98384 | A | 5/2016 |
| JP | 6070912 | B1 | 2/2017 |
| JP | 6119924 | B1 | 4/2017 |
| JP | 6180783 | B2 | 7/2017 |
| TW | 201704501 | A | 2/2017 |

(Continued)

OTHER PUBLICATIONS

Extended European Search Report, dated Feb. 5, 2020, for European Application No. 18851855.9.

(Continued)

*Primary Examiner* — Jessee R Roe

(74) *Attorney, Agent, or Firm* — Birch, Stewart, Kolasch & Birch, LLP

(57) ABSTRACT

[Object] To provide a steel sheet for carburizing that demonstrates improved extreme deformability prior to carburizing, and a method for manufacturing the same.

[Solution] A steel sheet consisting of, in mass %, C: more than or equal to 0.02%, and less than 0.30%, Si: more than or equal to 0.005%, and less than 0.5%, Mn: more than or equal to 0.01%, and less than 3.0%, P: less than or equal to 0.1%, S: less than or equal to 0.1%, sol. Al: more than or equal to 0.0002%, and less than or equal to 3.0%, N: less than or equal to 0.2%, and the balance: Fe and impurities, in which average value of X-ray random intensity ratio, assignable to an orientation group of ferrite crystal grain ranging from {100}<011> to {223}<110>, is 7.0 or smaller, average equivalent circle diameter of carbide is 5.0 μm or smaller, percentage of number of carbides with an aspect ratio of 2.0 or smaller is 80% or larger relative to the total carbides, and percentage of number of carbides present in the ferrite crystal grain is 60% or larger relative to the total carbides.

4 Claims, No Drawings

(56) References Cited

FOREIGN PATENT DOCUMENTS

| | | | |
|---|---|---|---|
| TW | 201708569 | A | 3/2017 |
| WO | WO 2016/148037 | A1 | 9/2016 |
| WO | WO 2016/190370 | A1 | 12/2016 |
| WO | WO 2016/190396 | A1 | 12/2016 |
| WO | WO 2016/204288 | A1 | 12/2016 |

OTHER PUBLICATIONS

International Search Report for PCT/JP2018/032111 (PCT/ISA/210) dated Nov. 27, 2018.
Taiwanese Search Report issued in TW 107130365 dated Mar. 18, 2019.
Written Opinion of the International Searching Authority for PCT/JP2018/032111 (PCT/ISA/237) dated Nov. 27, 2018.

* cited by examiner

STEEL SHEET FOR CARBURIZING, AND METHOD FOR MANUFACTURING STEEL SHEET FOR CARBURIZING

TECHNICAL FIELD

The present invention relates to a steel sheet for carburizing, and a method for manufacturing the steel sheet for carburizing.

BACKGROUND ART

In recent years, mechanical and structural parts such as automotive gear, clutch plate and damper have been required to be highly durable, and in addition to be manufacturable at low costs. These parts have widely been manufactured by cutting and carburizing using hot-forged materials. However, in response to increasing need for cost reduction, having been developed are technologies by which hot-rolled steel sheet or cold-rolled steel sheet, employed as a starting material, is cold-worked into shapes of the parts, followed by carburizing. In the cold-working, the material is punched, and then pressed typically by bending, drawing or hole expansion. Extreme deformability is required for needs of molding into intricate shapes typically for damper component of torque converter. "Extreme deformability" in this context is a physical property value given by natural logarithm of reduction of cross sectional area observed at a fracture part of a tensile specimen, and is known to be positively correlated to hole expandability. From this point of view, a variety of technologies have recently been proposed.

For example, Patent Literature 1 listed below proposes a technology for forming a structure of a hot-rolled steel sheet with ferrite and pearlite, and then spherodizing carbide by spherodizing annealing.

Meanwhile, Patent Literature 2 listed below proposes a technology for improving impact characteristics of a carburized member, by controlling particle size of carbide, as well as controlling percentage of the number of carbides at ferrite crystal grain boundaries relative to the number of carbides within ferrite particles, and further by controlling crystal size of the ferrite matrix.

Moreover, Patent Literature 3 listed below proposes a technology for improving cold workability, by controlling particle size and aspect ratio of carbide, as well as controlling crystal size of ferrite matrix, and further by controlling aspect ratio of ferrite.

CITATION LIST

Patent Literature

Patent Literature 1: JP 3094856B
Patent Literature 2: WO 2016/190370
Patent Literature 3: WO 2016/148037

SUMMARY OF INVENTION

Technical Problem

The aforementioned mechanical and structural parts are required to be hardenable for enhanced strength. In other words, in order to enable cold forming of intricately shaped components, it is required to achieve hole expandability (that is, to achieve good extreme deformability), while keeping the hardenability.

It is, however, difficult for the manufacturing method described in Patent Literature 1, mainly relying upon control of the microstructure of carbide, to suitably enhance the cold workability, particularly hole expandability. Meanwhile, Patent Literature 2 has not examined improvement in cold workability before carburization at all. Moreover, it is difficult for the technology proposed in Patent Literature 3 to achieve hole expandability that makes the intricately shaped components durable enough to cold working. As described above, it has been difficult for the technologies ever proposed to fully enhance the hole expandability of the steel sheet for carburizing, and this has restricted the steel sheet for carburizing to be applied to intricately shaped components, particularly to damper component of torque converter.

The present invention was made in consideration of the aforementioned problems, aiming at providing a steel sheet for carburizing that demonstrates improved extreme deformability prior to carburizing, and a method for manufacturing the same.

Solution to Problem

The present inventors extensively examined methods for solving the aforementioned problems, and consequently reached an idea that the hole expandability can be improved (that is, good extreme deformability can be imparted), while keeping the hardenability, by controlling ferrite texture in the hot-rolled steel sheet, so as to appropriately control X-ray random intensity ratio assignable to a specific orientation group of ferrite crystal grain, as will be detailed later, and reached the present invention.

Summary of the present invention reached on the basis of such idea is as follows.

[1]

A steel sheet for carburizing consisting of, in mass %,
C: more than or equal to 0.02%, and less than 0.30%,
Si: more than or equal to 0.005%, and less than 0.5%,
Mn: more than or equal to 0.01%, and less than 3.0%,
P: less than or equal to 0.1%,
S: less than or equal to 0.1%,
sol. Al: more than or equal to 0.0002%, and less than or equal to 3.0%,
N: less than or equal to 0.2%, and
the balance: Fe and impurities, in which average value of X-ray random intensity ratio, assignable to an orientation group of ferrite crystal grain ranging from {100}<011> to {223}<110>, is 7.0 or smaller, average equivalent circle diameter of carbide is 5.0 μm or smaller, percentage of number of carbides with an aspect ratio of 2.0 or smaller is 80% or larger relative to the total carbides, and percentage of number of carbides present in the ferrite crystal grain is 60% or larger relative to the total carbides.

[2]

The steel sheet for carburizing according to [1], further including, in place of part of the balance Fe, one of, or two or more of, in mass %,
Cr: more than or equal to 0.005%, and less than or equal to 3.0%,
Mo: more than or equal to 0.005%, and less than or equal to 1.0%,
Ni: more than or equal to 0.010%, and less than or equal to 3.0%, Cu: more than or equal to 0.001%, and less than or equal to 2.0%, Co: more than or equal to 0.001%, and less than or equal to 2.0%, Nb: more than or equal to 0.010%, and less than or equal to 0.150%, Ti: more than or equal to 0.010%, and less than or equal to 0.150%, V: more than or equal to 0.0005%, and less than or equal to 1.0%, and B: more than or equal to 0.0005%, and less than or equal to 0.01%.

[3]

The steel sheet for carburizing according to [1] or [2], further including, in place of part of the balance Fe, one of, or two or more of, in mass %, Sn: less than or equal to1.0%, W: less than or equal to 1.0%, Ca: less than or equal to 0.01%, and REM: less than or equal to 0.3%.

[4]

A method for manufacturing the steel sheet for carburizing according to any one of [1] to [3], the method including:

a hot-rolling step, in which a steel material having the chemical composition according to any one of [1] to [3] is heated, then rolled in a second last pass prior to hot finish rolling in a temperature range of 900° C. or higher and 980° C. or lower at a draft of 15% or larger and 25% or smaller, the hot finish rolling is terminated in a temperature range of 800° C. or higher and lower than 920° C. at a draft of 6% or larger, and the steel sheet is wound up at a temperature of 700° C. or lower; and an annealing step, in which the steel sheet obtained by the hot-rolling step, or the steel sheet cold-rolled subsequently to the hot-rolling step is heated in an atmosphere with nitrogen concentration controlled to less than 25% in volume fraction, at an average heating rate of 5° C./h or higher and 100° C./h or lower, up into a temperature range not higher than point $Ac_1$ defined by equation (1) below, annealed in a temperature range not higher than the point $Ac_1$ for 10 h or longer and 100 h or shorter, and then cooled at an average cooling rate of 5° C./h or higher and 100° C./h or lower in a temperature range from a temperature at the end of annealing down to 550° C.

[Math. 1]

$$Ac_1=750.8-26.6[C]+17.6[Si]-11.6[Mn]-22.9[Cu]-23[Ni]+24.1[Cr]+22.5[Mo]-39.7[V]-5.7[Ti]+232.4[Nb]-169.4[Al]-894.7[B] \quad \text{Equation (1).}$$

In equation (1) above, notation [X] represents the content of element X (in mass %), which is substituted by zero if such element X is absent.

Advantageous Effects of Invention

As explained above, according to the present invention, it now becomes possible to provide a steel sheet for carburizing that demonstrates improved extreme deformability prior to carburizing.

DESCRIPTION OF EMBODIMENTS

Preferred embodiments of the present invention will be detailed below.

(Details of Examination Made by Present Inventors, and Reached Idea)

Prior to description on the steel sheet for carburizing and the method for manufacturing the same according to the present invention, the examination made by the present inventors, aimed at solving the aforementioned problems, will be detailed below.

In the examination, the present inventors started first by examining a method for improving the hole expandability which is correlated to the extreme deformability.

In order to improve the hole expandability, it is important to suppress cracking during hole expansion, and further to suppress, if the cracking once occurred, propagation of the produced crack. Control of the aspect ratio (long axis/short axis) of carbide produced in the steel sheet is effective to suppress the cracking, posing importance of reduction of the aspect ratio of carbide by spherodizing annealing. Meanwhile, suppression of production of coarse carbide, and control of position of precipitation of carbide are effective to suppress propagation of the crack. That is, since carbide produced in the grain boundary of ferrite can promote the crack to propagate while routed through the grain boundary, so that it is important to produce carbide inside crystal grains of ferrite. Such propagation of crack through the grain boundary is considered to be suppressed by producing carbide inside the crystal grains of ferrite.

After employing such structural control, the present inventors further focused on texture control of ferrite matrix for improving the hole expandability, and made thorough investigations and researches on operations and effects of the texture control. As a result, the present inventors found that the hole expandability may dramatically be improved by controlling X-ray random intensity ratio assignable to a specific crystal orientation group.

More specifically, the present inventors found that the hole expandability of the steel sheet for carburizing was dramatically improved by controlling average value of X-ray random intensity ratio assignable to an orientation group of ferrite crystal grain ranging from {100}<011> to {223}<110>, to 7.0 or smaller. Although the reason why the X-ray random intensity ratio assignable to such crystal orientation group is so important for the hole expandability partially remains unclear, it is supposedly correlated to tendency of cracking during hole expansion. The present invention succeeded in dramatically improving the hold expandability of the steel sheet for carburizing, by controlling the aspect ratio of carbide and the position of precipitation of carbide, and further by controlling the X-ray random intensity ratio assignable to a specific crystal orientation group of ferrite crystal grain.

In addition, the present inventors reached an idea that the X-ray random intensity ratio assignable to a specific crystal orientation group of ferrite crystal grain is controllable by controlling finish rolling conditions in hot rolling. Among from crystal orientations of ferrite, the orientation group ranging from {100}<011> to {223}<110> relates to a crystal grain of ferrite that is produced as a result of phase transition from austenite not yet recrystallized. The present inventors found that such specific crystal orientation group may be suppressed from being produced by promoting recrystallization of austenite under controlled finish rolling conditions, and thereby it becomes possible to control the X-ray random intensity ratio, assignable to the orientation group of ferrite crystal grain ranging from {100}<011> to {223}<110>, to 7.0 or smaller.

The previous technologies, including those disclosed in Patent Literature 1 to Patent Literature 3, have not paid attention to control of ferrite texture in the hot-rolled steel sheet, for the purpose of enhancing the extreme deformability of steel sheet for carburizing. Hence there has been no practice of controlling temperature and draft in the second last pass prior to hot finish rolling, and further controlling temperature and draft in the hot finish rolling, as detailed later. The present invention succeeded in obtaining the steel sheet for carburizing with further improved extreme deformability, by suitably controlling conditions for example in hot finish rolling.

Note that regarding improvement in the hole expandability as a result of controlling the X-ray random intensity ratio, assignable to the orientation group of ferrite crystal grain ranging from {100}<011> to {223}<110>, to 7.0 or smaller, the larger the hardenability of steel sheet is, the larger the effect of improvement. For example, the hole expandability distinctively improves in high strength steel sheet with a tensile strength of 340 MPa or larger, such as those in 340 MPa class and 440 MPa class. Hence it will become possible to improve the hole expandability while keeping the hardenability, as a result of the structural control outlined above. In this way, the steel sheet for carburizing suitably balanced between the hardenability and hole expandability is now obtainable.

The steel sheet for carburizing and the method for manufacturing the same according to embodiments of the present invention, as detailed later, have been reached on the basis of the aforementioned findings. Paragraphs below will detail the steel sheet for carburizing and the method for manufacturing the same according to the embodiments reached on the basis of the findings.

(Steel Sheet for Carburizing)

First, the steel sheet for carburizing according to the embodiment of the present invention will be detailed.

The steel sheet for carburizing according to the embodiment has a predetermined chemical composition detailed below. In addition, the steel sheet for carburizing according to the embodiment has a specific microstructure featured by an average value of X-ray random intensity ratio, assignable to the orientation group of ferrite crystal grain ranging from {100}<011> to {223}<110>, of 7.0 or smaller, an average equivalent circle diameter of carbide of 5.0 μm or smaller, a percentage of the number of carbides with an aspect ratio of 2.0 or smaller of 80% or larger relative to the total carbides, and a percentage of number of carbides present in the ferrite crystal grain of 60% or larger relative to the total carbides. In this way, the steel sheet for carburizing according to the embodiment will have further improved extreme deformability prior to carburizing.

<Chemical Composition of Steel Sheet for Carburizing>

First, chemical components contained in the steel sheet for carburizing according to the embodiment will be detailed below. Note that in the following description, notation "%" relevant to the chemical components means "mass %", unless otherwise specifically noted.

[C: More than or Equal to 0.02%, and Less than 0.30%]

C (carbon) is an element necessary for keeping strength at the center of thickness of a finally obtainable carburized member. In the steel sheet for carburizing, C is also an element solid-soluted into the grain boundary of ferrite to enhance the strength of the grain boundary, to thereby contribute to improvement of the hole expandability.

With the content of C less than 0.02%, the aforementioned effect of improving the hole expandability will not be obtained. Hence the content of C in the steel sheet for carburizing according to the embodiment is specified to be more than or equal to 0.02%. The content of C is preferably more than or equal to 0.05%. Meanwhile, with the content of C more than or equal to 0.30%, carbide produced in the steel sheet for carburizing will have an average equivalent circle diameter exceeding 5.0 μm, thereby the hole expandability will degrade. Hence the content of C in the steel sheet for carburizing according to the embodiment is specified to be less than 0.30%. The content of C is preferably less than or equal to 0.20%. Note that, taking a balance between hole expandability and hardenability into account, the content of C is further preferably be less than or equal to 0.10%.

[Si: More than or Equal to 0.005%, and Less than 0.5%]

Si (silicon) is an element that acts to deoxidize molten steel to improve soundness of the steel. With the content of Si less than 0.005%, the molten steel will not thoroughly be deoxidized. Hence the content of silicon in the steel sheet for carburizing according to the embodiment is specified to be more than or equal to 0.005%. The content of Si is preferably more than or equal to 0.01%. Meanwhile, with the content of Si more than or equal to 0.5%, Si having been solid-soluted in carbide will stabilize the carbide and will allow the carbide to have an average equivalent circle diameter exceeding 5.0 μm, degrading the hole expandability. Hence the content of Si in the steel sheet for carburizing according to the embodiment is specified to be less than 0.5%. The content of Si is preferably less than 0.3%.

[Mn: More than or Equal to 0.01%, and Less than 3.0%]

Mn (manganese) is an element that acts to deoxidize molten steel to improve soundness of the steel. With the content of Mn less than 0.01%, the molten steel will not thoroughly be deoxidized. Hence the content of Mn in the steel sheet for carburizing according to the embodiment is specified to be more than or equal to 0.01%. The content of Mn is preferably more than or equal to 0.1%. Meanwhile, with the content of Mn more than or equal to 3.0%, Mn having been solid-soluted in carbide will stabilize the carbide and will allow the carbide to have an average equivalent circle diameter exceeding 5.0 μm, degrading the hole expandability. Hence the content of Mn is specified to be less than 3.0. The content of Mn is more preferably less than 2.0%, and even more preferably less than 1.0%.

[P: Less than or Equal to 0.1%]

P (phosphorus) is an element that segregates in the grain boundary of ferrite to degrade the hole expandability. With the content of P exceeding 0.1%, the grain boundary of ferrite will have considerably reduced strength, and thereby the hole expandability will degrade. Hence, the content of P in the steel sheet for carburizing according to the embodiment is specified to be less than or equal to 0.1%. The content of P is preferably less than or equal to 0.050%, and more preferably less than or equal to 0.020%. Note that the lower limit of the content of P is not specifically limited. The content of P reduced below 0.0001% will however considerably increase cost for dephosphorization, causing economic disadvantage. Hence the lower limit of content of P will substantially be 0.0001% for practical steel sheet.

[S: Less than or Equal to 0.1%]

S (sulfur) is an element that can form an inclusion to degrade the hole expandability. With the content of S exceeding 0.1%, a coarse inclusion will be produced, and thereby the hole expandability will degrade. Hence the content of S in the steel sheet for carburizing according to the embodiment is specified to be less than or equal to 0.1%. The content of S is preferably less than or equal to 0.010%, and more preferably less than or equal to 0.008%. Note that the lower limit of content of S is not specifically limited. The content of S reduced below 0.0005% will however considerably increase cost for desulfurization, causing economic disadvantage. Hence, the lower limit of content of S will substantially be 0.0005% for practical steel sheet.

[Sol. Al: More than or Equal to 0.0002%, and Less than or Equal to 3.0%]

Al (aluminum) is an element that acts to deoxidize molten steel to improve soundness of the steel. With the content of Al less than 0.0002%, the molten steel will not thoroughly be deoxidized. Hence the content of Al (in more detail, the content of sol. Al) in the steel sheet for carburizing according to the embodiment is specified to be more than or equal to 0.0002%. The content of Al is preferably more than or equal to 0.0010%. Meanwhile, with the content of Al exceeding 3.0%, coarse oxide will be produced, and thereby the hole expandability will degrade. Hence the content of Al is specified to be less than or equal to 3.0%. The content of Al is preferably less than or equal to 2.5%, more preferably less than or equal to 1.0%, even more preferably less than or equal to 0.5%, and yet more preferably less than or equal to 0.1%.

[N: Less than or Equal to 0.2%]

N (nitrogen) is an impurity element, and forms nitride to degrade the hole expandability. With the content of N exceeding 0.2%, coarse nitride will be produced, and thereby the hole expandability will be degraded considerably. Hence, the content of N in the steel sheet for carburizing according to the embodiment is specified to be less than or equal to 0.2%. The content of N is preferably less than or equal to 0.1%, more preferably less than or equal to 0.02%, and even more preferably less than or equal to 0.01%. Meanwhile, the lower limit of content of N is not specifically limited. The content of N reduced below 0.0001% will however considerably increase cost for denitrification, causing economic disadvantage. Hence, the lower limit of content of N will substantially be 0.0001% for practical steel sheet.

[Cr: More than or Equal to 0.005%, and Less than or Equal to 3.0%]

Cr (chromium) is an element having an effect of increasing the hardenability of the finally obtainable carburized member, and is also an element, for the steel sheet for carburizing, having an effect of micronizing ferrite crystal grains to further improve the hole expandability. Hence in the steel sheet for carburizing according to the embodiment, Cr may be contained as needed. In order to obtain more enhanced effect of hole expandability, the content of Cr, if contained, is preferably specified to be more than or equal to 0.005%. The content of Cr is more preferably more than or equal to 0.010%. Further, in consideration of the effects of production of carbide and nitride, the content of Cr is preferably less than or equal to 3.0%, in view of obtaining more enhanced effect of hole expandability. The content of Cr is more preferably less than or equal to 2.0%, and even more preferably less than or equal to 1.5%.

[Mo: More than or Equal to 0.005%, and Less than or Equal to 1.0%]

Mo (molybdenum) is an element having an effect of increasing the hardenability of the finally obtainable carburized member, and is also an element, for the steel sheet for carburizing, having an effect of micronizing ferrite crystal grains to further improve the hole expandability. Hence in the steel sheet for carburizing according to the embodiment, Mo may be contained as needed. In order to obtain more enhanced effect of hole expandability, the content of Mo, if contained, is preferably specified to be more than or equal to 0.005%. The content of Mo is more preferably more than or equal to 0.010%. Further, in consideration of the effects of production of carbide and nitride, the content of Mo is preferably less than or equal to 1.0%, in view of obtaining more enhanced effect of hole expandability. The content of Mo is more preferably less than or equal to 0.8%.

[Ni: More than or Equal to 0.010%, and Less than or Equal to 3.0%]

Ni (nickel) is an element having an effect of increasing the hardenability of the finally obtainable carburized member, and is also an element, for the steel sheet for carburizing, having an effect of micronizing ferrite crystal grains to further improve the hole expandability. Hence in the steel sheet for carburizing according to the embodiment, Ni may be contained as needed. In order to obtain more enhanced effect of hole expandability, the content of Ni, if contained, is preferably specified to be more than or equal to 0.010%. The content of Ni is more preferably more than or equal to 0.050%. Further, in consideration of the effects of segregation of Ni in the grain boundary, the content of Ni is preferably less than or equal to 3.0%, in view of obtaining more enhanced effect of hole expandability. The content of Ni is more preferably less than or equal to 2.0%, even more preferably less than or equal to 1.0%, and yet more preferably less than or equal to 0.5%.

[Cu: More than or Equal to 0.001%, and Less than or Equal to 2.0%]

Cu (copper) is an element having an effect of increasing the hardenability of the finally obtainable carburized member, and is also an element, for the steel sheet for carburizing, having an effect of micronizing ferrite crystal grains to further improve the hole expandability. Hence in the steel sheet for carburizing according to the embodiment, Cu may be contained as needed. In order to obtain more enhanced effect of hole expandability, the content of Cu, if contained, is preferably specified to be more than or equal to 0.001%. The content of Cu is more preferably more than or equal to 0.010%. Further, in consideration of the effects of segregation of Cu in the grain boundary, the content of Cu is preferably less than or equal to 2.0%, in view of obtaining more enhanced effect of hole expandability. The content of Cu is more preferably less than or equal to 0.80%.

[Co: More than or Equal to 0.001%, and Less than or Equal to 2.0%]

Co (cobalt) is an element having an effect of increasing the hardenability of the finally obtainable carburized member, and is also an element, for the steel sheet for carburizing, having an effect of micronizing ferrite crystal grains to further improve the hole expandability. Hence in the steel sheet for carburizing according to the embodiment, Co may be contained as needed. In order to obtain more enhanced effect of hole expandability, the content of Co, if contained, is preferably specified to be more than or equal to 0.001%. The content of Co is more preferably more than or equal to 0.010%. Further, in consideration of the effects of segregation of Co in the grain boundary, the content of Co is preferably less than or equal to 2.0%, in view of obtaining more enhanced effect of hole expandability. The content of Co is more preferably less than or equal to 0.80%.

[Nb: More than or Equal to 0.010%, and Less than or Equal to 0.150%]

Nb (niobium) is an element that contributes to micronize ferrite crystal grains to further improve the hole expandability. Hence in the steel sheet for carburizing according to the embodiment, Nb may be contained as needed. In order to obtain more enhanced effect of hole expandability, the content of Nb, if contained, is preferably specified to be more than or equal to 0.010%. The content of Nb is more preferably more than or equal to 0.035% Further, in consideration of the effects of production of carbide and nitride, the content of Nb is preferably less than or equal to 0.150%, in view of obtaining more enhanced effect of hole expandability. The content of Nb is more preferably less than or equal to 0.120%, and even more preferably less than or equal to 0.100%.

[Ti: More than or Equal to 0.010%, and Less than or Equal to 0.150%]

Ti (titanium) is an element that contributes to micronize ferrite crystal grains to further improve the hole expandability. Hence in the steel sheet for carburizing according to the embodiment, Ti may be contained as needed. In order to obtain more enhanced effect of hole expandability, the content of Ti, if contained, is preferably specified to be more than or equal to 0.010%. The content of Ti is more preferably more than or equal to 0.035% Further, in consideration of the effects of production of carbide and nitride, the content of Ti is preferably less than or equal to 0.150%, in view of obtaining more enhanced effect of hole expandability. The content of Ti is more preferably less than or equal to 0.120%, even more preferably less than or equal to 0.100%, yet more preferably less than or equal to 0.050%, and furthermore preferably less than or equal to 0.020%.

[V: More than or Equal to 0.0005%, and Less than or Equal to 1.0%]

V (vanadium) is an element that contributes to micronize ferrite crystal grains to further improve the hole expandability. Hence in the steel sheet for carburizing according to the embodiment, V may be contained as needed. In order to obtain more enhanced effect of hole expandability, the content of V, if contained, is preferably specified to be more than or equal to 0.0005%. The content of V is more preferably more than or equal to 0.0010% Further, in consideration of the effects of production of carbide and nitride, the content of V is preferably less than or equal to 1.0%, in view of obtaining more enhanced effect of hole expandability. The content of V is more preferably less than or equal to 0.80%, even more preferably less than or equal to 0.10%, and yet more preferably less than or equal to 0.080%.

[B: More than or Equal to 0.0005%, and Less than or Equal to 0.01%]

B (boron) is an element that segregates in the grain boundary of ferrite to enhance strength of the grain boundary, to thereby further improve the hole expandability. Hence in the steel sheet for carburizing according to the embodiment, B may be contained as needed. In order to obtain more enhanced effect of hole expandability, the content of B, if contained, is preferably specified to be more than or equal to 0.0005%. The content of B is more preferably more than or equal to 0.0010% Note that, such more enhanced effect of hole expandability will saturate if the content of B exceeds 0.01%, so that the content of B is preferably specified to be less than or equal to 0.01%. The content of B is more preferably less than or equal to 0.0075%, even more preferably less than or equal to 0.0050%, and yet more preferably less than or equal to 0.0020%.

[Sn: Less than or Equal to 1.0%]

Sn (tin) is an element that acts to deoxidize molten steel to improve soundness of the steel. Hence in the steel sheet for carburizing according to the embodiment, Sn may be contained as needed at a maximum content of 1.0%. The content of Sn is more preferably less than or equal to 0.5%.

[W: Less than or Equal to 1.0%]

W (tungsten) is an element that acts to deoxidize molten steel to improve soundness of the steel. Hence in the steel sheet for carburizing according to the embodiment, W may be contained as needed at a maximum content of 1.0%. The content of W is more preferably less than or equal to 0.5%.

[Ca: Less than or Equal to 0.01%]

Ca (calcium) is an element that acts to deoxidize molten steel to improve soundness of the steel. Hence in the steel sheet for carburizing according to the embodiment, Ca may be contained as needed at a maximum content of 0.01%. The content of Ca is more preferably less than or equal to 0.006%.

[REM: Less than or Equal to 0.3%]

REM (rare metal) is element(s) that act(s) to deoxidize molten steel to improve soundness of the steel. Hence in the steel sheet for carburizing according to the embodiment, REM may be contained as needed at a maximum content of 0.3%.

Note that REM is a collective name for 17 elements in total including Sc (scandium), Y (yttrium) and the lanthanide series elements, and the content of REM means the total amount of these elements. Although misch metal is often used to introduce REM, in some cases also the lanthanide series elements besides La (lanthanum) and Ce (cerium) may be introduced in a combined manner. Also in this case, the steel sheet for carburizing according to the embodiment will exhibit excellent extreme deformability. In addition, the steel sheet for carburizing according to the embodiment will exhibit excellent extreme deformability, even if metallic REM such as metallic La and Ce are contained.

[Balance: Fe and Impurities]

The balance of the component composition at the center of thickness includes Fe and impurities. The impurities are exemplified by elements derived from the starting steel or scrap, and/or inevitably incorporated in the process of steel making, which are acceptable so long as characteristics of the steel sheet for carburizing according to the embodiment will not be adversely affected.

Chemical components contained in the steel sheet for carburizing according to the embodiment have been detailed.

<Microstructure of Steel Sheet for Carburizing>

Next, the microstructure that makes up the steel sheet for carburizing according to the embodiment will be detailed.

The microstructure of the steel sheet for carburizing according to the embodiment is substantially composed of ferrite and carbide. In more detail, the microstructure of the steel sheet for carburizing according to the embodiment is composed so that the percentage of area of ferrite typically falls in the range from 80 to 95%, the percentage of area of carbide typically falls in the range from 5 to 20%, and the total percentage of area of ferrite and carbide will not exceed 100%.

Such percentages of area of ferrite and carbide are measured by using a sample sampled from the steel sheet for carburizing so as to produce the cross section to be observed in the direction perpendicular to the width direction. A length of sample of 10 mm to 25 mm or around will suffice, although depending on types of measuring instrument. The surface to be observed of the sample is polished, and then etched using nital. The surface to be observed, after etched with nital, is observed in regions at a quarter thickness position (which means a position in the thickness direction of the steel sheet for carburizing, quarter thickness away from the surface), at a ⅜ thickness position, and at the half thickness position, under a thermal-field-emission type scanning electron microscope (for example, JSM-7001F from JEOL, Ltd.).

Each sample is observed for the regions having an area of 2500 $\mu m^2$ in ten fields of view, and percentages of areas occupied by ferrite and carbide relative to the area of field of view are measured for each field of view. An average value of percentages of area occupied by ferrite, being averaged from all fields of view, and, an average value of percentages of area occupied by carbide, being averaged from all fields of view, are respectively denoted as the percentage of area of ferrite, and, the percentage of area of carbide.

Now the carbide in the microstructure according to the embodiment is mainly iron carbide such as cementite which is a compound of iron and carbon ($Fe_3C$), and, ε carbide ($Fe_{2-3}C$). Alternatively, besides the aforementioned iron carbide, the carbide in the microstructure occasionally contains a compound derived from cementite having Fe atoms substituted by Mn, Cr and so forth, and alloy carbides (such as $M_{23}C_6$, $M_6C$ and MC, where M represents Fe and other metal element, or, metal element other than Fe). Most part of the carbide in the microstructure according to the embodiment is composed of iron carbide. Hence, focusing now on the later-detailed number of such carbides, the number may be the total number of the aforementioned various carbides, or may be the number of iron carbide only. That is, the later-described various percentages of the number of carbides may be defined on the basis of a population that contains various carbides including iron carbide, or may be defined on the basis of a population that contains iron carbide only. The iron carbide may be identified typically by subjecting the sample to diffractometry or EDS (Energy Dispersive X-ray spectrometry).

The steel sheet for carburizing, if punched and then subjected to hole expansion, can cause cracks at the punched edge due to concentration of deforming stress, and the cracks may further propagate during the working continued thereafter. The cracks tend to occur in regions where hardness largely differs between the adjoining structures, such as an interface where a soft structure and a hard structure adjoin. The steel sheet for carburizing according to the embodiment, composed of ferrite and carbide, is likely to cause cracking at the interface between ferrite and carbide during hole expansion, as described above. In this event, if the carbide has a flat form, the stress will easily be concentrated at the end of carbide, making the cracking more likely to occur. It is therefore important to reduce the aspect ratio of carbide by spherodizing annealing. In addition, an effective way to suppress propagation of cracking is to suppress production of coarse carbide, as well as to control position of precipitation of carbide. That is, since carbide produced in the grain boundary of ferrite can promote the crack to propagate while routed through the grain boundary, so that it is important to produce carbide inside crystal grains of ferrite. Such propagation of crack through the grain boundary is considered to be suppressed by producing carbide inside the crystal grains of ferrite.

The present inventors additionally found that the crystal orientation of ferrite can largely affect the hole expandability. Deformation by hole expansion will proceed as a result of orientation rotation of ferrite crystal grains, during which adjoining crystal grains, which are less likely to cause orientation rotation, cannot endure the deformation, so that cracking occurs at the grain boundary. It was thus made clear that the hole expandability can be improved by controlling the amount of production of crystal grains that are less likely to cause orientation rotation.

Reasons for limiting the microstructure that makes up the steel sheet for carburizing according to the embodiment will be detailed below.

[Average Value of X-Ray Random Intensity Ratio, Assignable to Orientation Group of Ferrite crystal grain Ranging from {100}<011> to {223}<110>, Being 7.0 or Smaller]

From investigations by the present inventors, it was made clear that good hole expandability is obtainable, if the average value of X-ray random intensity ratio, assignable to an orientation group of ferrite crystal grain ranging from {100}<011> to {223}<110> is 7.0 or smaller. If the average value of X-ray random intensity ratio exceeds 7.0, the cracking during hole expansion will be promoted, so that good hole expandability will not be obtained. Hence for the steel sheet for carburizing according to the embodiment, the average value of X-ray random intensity ratio is specified to be 7.0 or smaller. For further improvement of the extreme deformability, the average value of X-ray random intensity ratio is preferably 5.5 or smaller. Note that the lower limit of X-ray random intensity ratio, although not specifically limited, is substantially 0.5, in consideration of current typical process of continuous hot rolling.

Note that the crystal orientation is typically denoted using [hkl] or {hkl} for the orientation perpendicular to the sheet surface, and using (uvw) or <uvw> for the orientation parallel to the direction of rolling. Notations {hkl} and <uvw> are collective notations for equivalent planes. Major orientations contained in the orientation group of ferrite crystal grain ranging from {100}<011> to {223}<110> are {100}<011>, {116}<110>, {114}<110>, {113}<110>, {112}<110>, {335}<110>, and {223}<110>.

Next, method of calculating metal structure will be explained.

First, a sample is cut out from the steel sheet for carburizing, so as to produce a cross section to be observed, which is perpendicular to the surface (thickness-wise cross section). A length of sample of 10 mm to 25 mm or around will suffice, although depending on types of measuring instrument. A region at around a quarter thickness position of the sample is analyzed at 0.1 μm intervals by electron back scattering diffraction (EBSD) method, to obtain information regarding crystal orientation. The EBSD analysis is now carried out by employing, for example, an apparatus that includes a thermal-field-emission type scanning electron microscope (for example, JSM-7001F from JEOL, Ltd.) and an EBSD detector (Model DVC5 detector, from TSL), at an electron beam accelerating voltage of 15 kV to 25 kV, and an analytical rate of 200 to 300 points/second. Using "TEXTURE" function of ancillary software "OIM Analysis (registered trademark)" of the EBSD analyzer, a three dimensional texture is calculated from the thus obtained information regarding crystal orientation using the series expansion method. Next, it suffices to use "ODF" function to obtain, from the three-dimensional texture, intensities assignable to (001)[1-10], (116)[1-10], (114)[1-10], (113)[1-10], (112)[1-10], (335)[1-10], and (223)[1-10] in the φ2=45° section, and to use the intensities directly as the X-ray random intensity ratio of ferrite crystal grain. The average value regarding the orientation group from {100}<011> to {223}<110> means an arithmetic mean derived from these orientations. For a case where the intensities are not available entirely from all these orientations, an arithmetic mean regarding, for example, {100}<011>, {116}<110>, {114}<110>, {112}<110>, and {223}<110> orientations may be used instead. Note although orientation "−1" would otherwise be given by "1" with an overline according to the formal notation in crystallography, the present specification employs the notation of "−1" due to limitation on description.

[Percentage of Number of Carbides with Aspect Ratio of 2.0 or Smaller, Relative to Total Carbides: 80% or Larger]

As described previously, the carbide according to the embodiment is mainly composed of iron carbides such as cementite ($Fe_3C$) and, ε carbide ($Fe_{2-3}C$). Investigation by the present inventors revealed that good hole expandability is obtainable, if the percentage of the number of carbides with an aspect ratio of 2.0 or smaller, relative to the total carbides, is 80% or larger. With the percentage of the number of carbides with an aspect ratio of 2.0 or smaller relative to the total carbides fallen below 80%, good hole expandability will not be obtained due to accelerated cracking during hole expansion. Therefore in the steel sheet for carburizing according to the embodiment, the lower limit value of the percentage of the number of carbides with an aspect ratio of 2.0 or smaller, relative to the total carbides, is specified to be 80%. The percentage of the number of carbides with an aspect ratio of 2.0 or smaller relative to the total carbides is more preferably 85% or larger, for further improvement of the hole expandability. Note that there is no special limitation on the upper limit of the percentage of the number of carbides with an aspect ratio of 2.0 or smaller relative to the total carbides. Since, however, it is difficult to achieve 98% or larger in practical operation, 98% will be a substantial upper limit.

[Percentage of Number of Carbides Present in Ferrite Crystal Grain, Relative to Total Carbides: 60% or Larger]

Investigations by the present inventors revealed that good hole expandability is obtainable, if the percentage of the number of carbides present in ferrite crystal grain, relative to total carbides, is 60% or larger. With the percentage of the number of carbides present in ferrite crystal grain relative to total carbides fallen under 60%, good hole expandability will not be obtained due to accelerated cracking during hole expansion. Therefore in the steel sheet for carburizing according to the embodiment, the lower limit value of the percentage of the number of carbides present in ferrite crystal grain, relative to total carbides, is specified to be 60%. The percentage of the number of carbides present in ferrite crystal grain relative to total carbides is more preferably 65% or larger, for further improvement of the hole expandability. Note that there is no special limitation on the upper limit of the percentage of the number of carbides present in ferrite crystal grain relative to the total carbides. Since, however, it is difficult to achieve 98% or larger in practical operation, 98% will be a substantial upper limit.

[Average Equivalent Circle Diameter of Carbide: 5.0 μm or Smaller]

In the microstructure of the steel sheet for carburizing according to the embodiment, the average equivalent circle diameter of carbide need be 5.0 μm or smaller. With the average equivalent circle diameter of carbide exceeding 5.0 μm, good hole expandability will not be obtained due to cracking that occurs during punching. The smaller the average equivalent circle diameter of carbide is, the more the cracking is unlikely to occur during punching. The average equivalent circle diameter is preferably 1.0 μm or smaller, more preferably 0.8 μm or smaller, and even more preferably 0.6 μm or smaller. The lower limit value of the average equivalent circle diameter of carbide is not specifically limited. Since, however, it is difficult to achieve an average equivalent circle diameter of carbide of 0.01 μm or smaller in practical operation, 0.01 μm will be a substantial lower limit.

Next, methods for measuring various percentages of the number of carbides in the microstructure and the average equivalent circle diameter of carbide will be detailed.

First, a sample is cut out from the steel sheet for carburizing, so as to produce a cross section to be observed, which is perpendicular to the surface (thickness-wise cross section). A length of sample of 10 mm or around will suffice, although depending on types of measuring instrument. The cross section is polished and corroded, and is then subjected to measurement of position of precipitation, aspect ratio, and average equivalent circle diameter of carbide. For the polishing, it suffices for example to polish the surface to be measured using a 600-grit to 1500-grit silicon carbide sandpaper, and then to specularly finish the surface using a liquid having diamond powder of 1 μm to 6 μm in diameter dispersed in a diluent such as alcohol or in water. The corrosion is not specifically limited so long as the shape and position of precipitation of carbide can be observed. In order to corrode the grain boundary between carbide and matrix iron, it is suitable to employ, for example, etching using a saturated picric acid-alcohol solution; or a method for removing the matrix iron to a depth of several micrometers typically by potentiostatic electrolytic etching using a non-aqueous solvent-based electrolyte (Fumio Kurosawa et al., Journal of the Japan Institute of Metals and Materials (in Japanese), 43, 1068, (1979)), so as to allow the carbide only to remain.

The aspect ratio of carbide is estimated by observing a 10000 $\mu m^2$ area at around a quarter thickness position of the sample, under a thermal-field-emission type scanning electron microscope (for example, JSM-7001F from JEOL, Ltd.). All carbides contained in an observed field of view are measured regarding the long axes and the short axes to calculate aspect ratios (long axis/short axis), and an average value of the aspect ratios is determined. Such observation is made in five fields of view, and an average value for these five fields of view is determined as the aspect ratio of carbide in the sample. Referring to the thus obtained aspect ratio of carbide, the percentage of the number of carbides with an aspect ratio of 2.0 or smaller relative to the total carbides is calculated, on the basis of the total number of carbides with an aspect ratio of 2.0 or smaller, and the total number of carbides present in the five fields of view.

The position of precipitation of carbide is confirmed by observing a 10000 $\mu m^2$ area at around a quarter thickness position of the sample, under a thermal-field-emission type scanning electron microscope (for example, JSM-7001F from JEOL, Ltd.). All carbides contained in an observed field of view are measured regarding the position of precipitation, and percentage of carbides that precipitated within the ferrite crystal grain, relative to the total number of carbides, is calculated. The observation is made in five fields of view, and an average value for these five fields of view is determined as the percentage of carbides formed within the ferrite crystal grain, among from the carbides (that is, the percentage of the number of carbides present within the ferrite crystal grain, among from the total carbides).

The average equivalent circle diameter of carbide is estimated by observing a 600 $\mu m^2$ area at around a quarter thickness position of the sample in four fields of view, under a thermal-field-emission type scanning electron microscope (for example, JSM-7001F from JEOL, Ltd.). For each field of view, the long axes and the short axes of captured carbides are individually measured, using image analysis software (for example, IMage-Pro Plus from Media Cybernetics, Inc.). For each carbide in the field of view, the long axis and the short axis are averaged to obtain the diameter of carbide, and the diameters obtained from all carbides captured in the field of view are averaged. The thus obtained average values of the diameter of carbides from four fields of view are further averaged by the number of fields of view, to determine the average equivalent circle diameter of carbide.

The microstructure possessed by the steel sheet for carburizing according to the embodiment has been detailed.

<Thickness of Steel Sheet for Carburizing>

The thickness of the steel sheet for carburizing according to the embodiment is not specifically limited, but is preferably 2 mm or larger, for example. With the thickness of the steel sheet for carburizing specified to be 2 mm or larger, difference of thickness in the coil width direction may further be reduced. The thickness of the steel sheet for carburizing is more preferably 2.3 mm or larger. Further, the thickness of the steel sheet for carburizing is not specifically limited, but is preferably 6 mm or smaller. With the thickness of the steel sheet for carburizing specified to be 6 mm or smaller, load of press forming may be reduced, making forming into components easier. The thickness of the steel sheet for carburizing is more preferably 5.8 mm or smaller.

The steel sheet for carburizing according to the embodiment has been detailed.

(Method for Manufacturing Steel Sheet for Carburizing)

Next, a method for manufacturing the above-explained steel sheet for carburizing according to the embodiment will be detailed.

The method for manufacturing the above-explained steel sheet for carburizing according to the embodiment includes (A) a hot-rolling step in which a steel material having the chemical composition explained above is used to manufacture the hot-rolled steel sheet according to predetermined conditions, and (B) an annealing step in which the thus obtained hot-rolled steel sheet, or the steel sheet cold-rolled subsequently to the hot-rolling step is annealed according to predetermined heat treatment conditions.

The hot-rolling step and the annealing step will be detailed below.

<Hot-Rolling Step>

The hot-rolling step described below is a step in which a steel material having the predetermined chemical composition is used to manufacture the hot-rolled steel sheet according to the predetermined conditions.

Steel billet (steel material) subjected now to hot-rolling may be any billet manufactured by any of usual methods. For example, employable is a billet manufactured by any of usual methods, such as continuously cast slab and thin slab caster.

In more detail, the steel material having the above-explained chemical composition is used. Such steel material is heated and subjected to hot-rolling, then rolled in the second last pass prior to hot finish rolling in a temperature range of 900° C. or higher and 980° C. or lower at a draft of 15% or larger and 25% or smaller, the hot finish rolling is terminated in a temperature range of 800° C. or higher and lower than 920° C. at a draft of 6% or larger, and the steel sheet is wound up at a temperature of 700° C. or lower; to thereby manufacture the hot-rolled steel sheet.

[Rolling Temperature in Second Last Pass Prior to Hot Finish Rolling: 900° C. or Higher, and 980° C. or Lower, Draft: 15% or Larger and 25% or Smaller]

In the hot rolling step according to the embodiment, recrystallization of austenite is promoted to produce austenitic grains with fewer lattice defects, by rolling in the second last pass prior to hot finish rolling. If the rolling temperature falls below 900° C., or the draft exceeds 25%, the austenite will have excessively introduced lattice defects, which will unnecessarily inhibit the recrystallization of austenite in the succeeding finish rolling step, making it unsuccessful to control the average value of X-ray random intensity ratio, assignable to the orientation group of ferrite crystal grain ranging from {100}<011> to {223}<110>, to 7.0 or smaller. Meanwhile, if the rolling temperature exceeds 980° C., or draft falls below 15%, the austenitic grain will be considerably coarsened, which will consequently inhibit the recrystallization of austenitic grain in the succeeding finish rolling step, making it unsuccessful to control the average value of X-ray random intensity ratio, assignable to the orientation group of ferrite crystal grain ranging from {100}<011> to {223}<110>, to 7.0 or smaller. From these points of view, in the hot-rolling step according to the embodiment, the rolling temperature in the second last pass prior to hot finish rolling is specified to be 900° C. or higher and 980° C. or lower, and the draft is specified to be 15% or larger and 25% or smaller. For more appropriate control of the average value of X-ray random intensity ratio assignable to the orientation group of ferrite crystal grain ranging from {100}<011> to {223}<110>, the rolling temperature in the second last pass prior to hot finish rolling is preferably 910° C. or higher. Further, for more appropriate control of the average value of X-ray random intensity ratio assignable to the orientation group of ferrite crystal grain ranging from {100}<011> to {223}<110>, the rolling temperature in the second last pass prior to hot finish rolling is preferably 970° C. or lower. For even more appropriate control of the average value of X-ray random intensity ratio assignable to the orientation group of ferrite crystal grain ranging from {100}<011> to {223}<110, the draft is preferably 17% or larger. Furthermore, for even more appropriate control of the average value of X-ray random intensity ratio assignable to the orientation group of ferrite crystal grain ranging from {100}<011> to {223}<110, the draft is preferably 20% or smaller.

[Rolling Temperature in Hot Finish Rolling: 800° C. or Higher, and Lower than 920° C., Draft: 6% or Larger]

In the hot-rolling step according to the embodiment, recrystallization of austenite is promoted by the hot finish rolling step. If the rolling temperature falls below 800° C., or the draft falls below 6%, recrystallization of austenite will not be fully promoted, making it unsuccessful to control the average value of X-ray random intensity ratio, assignable to the orientation group of ferrite crystal grain ranging from {100}<011> to {223}<110>, to 7.0 or smaller. Hence in the hot finish rolling according to the embodiment, the rolling temperature is specified to be 800° C. or higher, and the draft is specified to be 6% or larger. For more appropriate control of the average value of X-ray random intensity ratio assignable to the orientation group of ferrite crystal grain ranging from {100}<011> to {223}<110>, the rolling temperature in the hot finish rolling is preferably 810° C. or higher. Meanwhile, if the rolling temperature is 920° C. or higher, the austenitic grain of austenite will be considerably coarsened, consequently inhibiting production of ferrite in the succeeding step. Hence in the hot finish rolling according to the embodiment, the rolling temperature is specified to be lower than 920° C. For more appropriate control of the average value of X-ray random intensity ratio assignable to the orientation group of ferrite crystal grain ranging from {100}<011> to {223}<110>, the rolling temperature in the hot finish rolling is preferably lower than 910° C. Note that the upper limit of draft in the hot finish rolling according to the embodiment is not specifically limited. However, from the viewpoint of morphological stability of the hot-rolled steel sheet, a substantial upper limit will be 50%.

[Winding Temperature: 700° C. or Lower]

As mentioned previously, the microstructure of the steel sheet for carburizing need have an average equivalent circle diameter of carbide of 5.0 μm or smaller, an average value of X-ray random intensity ratio assignable to the orientation group of ferrite crystal grain ranging from {100}<011> to {223}<110> of 7.0 or smaller, a percentage of the number of carbides with an aspect ratio of 2.0 or smaller among from the total carbides of 80% or larger, and a percentage of the number of carbides formed within the ferrite crystal grains among from the total carbides of 60% or larger. Accordingly, the steel sheet before being subjected to the annealing step in the succeeding stage (in more detail, spherodizing annealing) preferably has a structure (hot-rolled steel sheet structure) that includes 10% or more and 80% or less, in percentage of area, of ferrite, and 10% or more and 60% or less, in percentage of area, of pearlite, totaling 100% or less in percentage of area, and the balance that preferably includes at least any of bainite, martensite, tempered martensite and residual austenite.

If the winding temperature in the hot-rolling step according to the embodiment exceeds 700° C., production of ferrite will be excessively promoted to suppress production of pearlite, making it difficult to control, finally in the steel sheet after the annealing step, the percentage of carbides with an aspect ratio of 2.0 or smaller, among from the carbides, to 80% or larger. Hence in the hot-rolling step according to the embodiment, the upper limit of the winding temperature is specified to be 700° C. The lower limit of the winding temperature in the hot-rolling step according to the embodiment is not specifically limited. Since, however, winding at room temperature or below is difficult in practical operation, room temperature will be a substantial lower limit. Note that the winding temperature in the hot-rolling step according to the embodiment is preferably 400° C. or higher, from the viewpoint of further reducing the aspect ratio of carbide in the annealing step in the succeeding stage.

Now in the aforementioned hot-rolling step according to the embodiment, the total number of passes of hot-rolling is not specifically limited, allowing a freely selectable number of passes. Also the draft in a pass before the second last pass prior to the hot finish rolling is not specifically limited, and may suitably be preset so that desired final thickness will be obtainable.

Alternatively, the steel sheet thus wound up in the aforementioned hot-rolling step (hot-rolled steel sheet) may be unwound, pickled, and then cold-rolled. Through removal of oxide on the surface of steel sheet by pickling, the hole expandability may further be improved. The pickling may be carried out once, or may be carried out in multiple times. The cold-rolling may be carried out at an ordinary draft (30 to 90%, for example). The hot-rolled steel sheet and cold-rolled steel sheet also include steel sheet temper-rolled under usual conditions, besides the steel sheets that are left unmodified after hot-rolled or cold-rolled.

The hot-rolled steel sheet is manufactured as described above, in the hot-rolling step according to the embodiment. The thus manufactured hot-rolled steel sheet, or the steel sheet cold-rolled subsequently to the hot-rolling step may further be subjected to specific annealing in the annealing step detailed below, to obtain the steel sheet for carburizing according to the embodiment.

<Annealing Step>

The annealing step detailed below is a step in which the hot-rolled steel sheet obtained in the aforementioned hot-rolling step, or the steel sheet cold-rolled subsequently to the hot-rolling step is subjected to annealing (spherodizing annealing) under predetermined heat treatment conditions. Through the annealing, pearlite having been produced in the hot-rolling step is spherodized.

In more detail, the hot-rolled steel sheet obtained as described above, or the steel sheet cold-rolled subsequently to the hot-rolling step is heated in an atmosphere with nitrogen concentration controlled to less than 25% in volume fraction, at an average heating rate of 5° C./h or higher and 100° C./h or lower, up into a temperature range not higher than point $Ac_1$ defined by equation (101) below, annealed in a temperature range not higher than the point $Ac_1$ for 10 h or longer and 100 h or shorter, and then cooled at an average cooling rate of 5° C./h or higher and 100° C./h or lower in a temperature range from a temperature at the end of annealing down to 550° C.

Now in the equation (101) below, the notation [X] represents the content of element X (in mass %), which will be substituted by zero if such element X is absent.

[Math. 2]

$$Ac_1=750.8-26.6[C]+17.6[Si]-11.6[Mn]-22.9[Cu]-23[Ni]+24.1[Cr]+22.5[Mo]-39.7[V]-5.7[Ti]+232.4[Nb]-169.4[Al]-894.7[B] \quad \text{Equation (1).}$$

[Annealing Atmosphere: Atmosphere with Nitrogen Concentration Controlled to Less than 25% in Volume Fraction]

In the aforementioned annealing step, the annealing atmosphere is specified so as to have the nitrogen concentration controlled to less than 25% in volume fraction. With the nitrogen concentration set to 25% or higher in volume fraction, nitride will be formed in the steel sheet to undesirably degrade the hole expandability. The lower the nitrogen concentration, the more desirable. Since, however, it is not cost-effective to control the nitrogen concentration below 1% in volume fraction, 1% in volume fraction will be a substantial lower limit of the nitrogen concentration.

Atmospheric gas is, for example, at least one gas appropriately selected from gases such as nitrogen and hydrogen, and inert gases such as argon. Such variety of gases may be used so as to adjust the nitrogen concentration in a heating furnace used for the annealing step to a desired value. The atmospheric gas may contain a gas such as oxygen if the content is not so much. Typically, the higher the hydrogen concentration in the atmospheric gas, the better. Typically by controlling the hydrogen concentration to 60% or more in volume fraction, heat conduction in an annealing apparatus may be enhanced, and thereby the production cost may be reduced. More specifically, the annealing atmosphere may have a hydrogen concentration of 95% or more in volume fraction, with the balance of nitrogen. The atmospheric gas in the heating furnace used for the annealing step may be controlled by, for example, appropriately measuring the gas concentration in the heating furnace, while introducing the aforementioned gas.

[Heating Condition: At Average Heating Rate of 5° C./h or Higher and 100° C./h or Lower, Up into Temperature Range not Higher than Point $Ac_1$]

In the annealing step according to the embodiment, the aforementioned hot-rolled steel sheet, or the steel sheet cold-rolled subsequently to the hot-rolling step need be heated at an average heating rate of 5° C./h or higher and 100° C./h or lower, up into a temperature range not higher than point $Ac_1$ defined by the equation (101) above. With the average heating rate set lower than 5° C./h, the average equivalent circle diameter of carbide will exceed 5.0 μm, degrading the hole expandability. Meanwhile, with an average heating rate exceeding 100° C./h, spherodizing of carbide will not be fully promoted, making it difficult to control the percentage of the number of carbides with an aspect ratio of 2.0 or smaller, among from the total carbides, to 80% or larger. Further, at a heating temperature exceeding point $Ac_1$ defined by the equation (101) above, the percentage of the number of carbides formed within the ferrite crystal grains among from the total carbides will fall under 60%, making it unsuccessful to obtain good hole expandability. Note that the lower limit of the temperature range of heating temperature is not specifically limited. However, in the temperature range of heating temperature below 600° C., retention time in annealing process will become longer, making the process not cost-effective. Hence, the temperature range of heating temperature is preferably specified to be 600° C. or higher. For more proper control of the state of carbide, the average heating rate in the annealing step according to the embodiment is preferably specified to be 20° C./h or higher. Further, for more proper control of the state of carbide, the average heating temperature in the annealing step according to the embodiment is preferably specified to be 50° C./h or lower. For more proper control of the state of carbide, the temperature range of heating temperature in the annealing step according to the embodiment is more preferably specified to be 630° C. or higher. Furthermore, for more proper control of the state of carbide, the temperature range of heating temperature in the annealing step according to the embodiment is more preferably specified to be 670° C. or lower.

[Retention Time: in Temperature Range not Higher than Point $Ac_1$, for 10 h or Longer and 100 h or Shorter]

In the annealing step according to the embodiment, the aforementioned temperature range not higher than point $Ac_1$ (preferably, 600° C. or higher and point $Ac_1$ or lower) need be kept for 10 h or longer and 100 h or shorter. With the retention time set shorter than 10 h, spherodizing of carbide will not be fully promoted, making it difficult to control the percentage of the number of carbides with an aspect ratio of 2.0 or smaller, among from the total carbides, to 80% or larger. Meanwhile, with the retention time exceeding 100 h, the average equivalent circle diameter of carbide will exceed 5.0 μm, degrading the hole expandability. For more proper control of the state of carbide, the retention time in the annealing step according to the embodiment is preferably 20 h or longer. Further, for more proper control of the state of carbide, the retention time in the annealing step according to the embodiment is preferably 80 h or shorter.

[Cooling Conditions: Cooled at Average Cooling Rate of 5° C./h or Higher and 100° C./h or Lower]

In the annealing step according to the embodiment, the steel sheet after the aforementioned retention under heating, is cooled at an average cooling rate of 5° C./h or higher and 100° C./h or lower. Now the average cooling rate in this context means an average cooling rate over the range from the temperature of retention under heating (in other words, the temperature at the end of annealing) down to 550° C. With the average cooling rate set below 5° C./h, the carbide will be excessively coarsened, degrading the hole expandability. Meanwhile, with the average cooling rate exceeding 100° C./h, spherodizing of carbide will not be fully promoted, making it difficult to control the percentage of the number of carbides with an aspect ratio of 2.0 or smaller, among from the total carbides, to 80% or larger. For more proper control of the state of carbide, the average cooling rate over the range from the temperature of retention under heating down to 550° C. is preferably specified to be 20° C./h or higher. Further, for more proper control of the state of carbide, the average cooling rate over the range from the temperature of retention under heating down to 550° C. is preferably specified to be 50° C./h or lower.

Note that, in the annealing step according to the embodiment, the average cooling rate in a temperature range below 550° C. is not specifically limited, allowing cooling at a freely selectable average cooling rate down into a predetermined temperature range. The lower limit of temperature at which the cooling is terminated is not specifically limited. Since, however, cooling below room temperature is difficult in practical operation, room temperature will be a substantial lower limit.

The annealing step according to the embodiment has been detailed.

By carrying out the aforementioned hot-rolling step and annealing step, the above-explained steel sheet for carburizing according to the embodiment may be manufactured.

Note that, prior to the above-explained annealing step, the hot-rolled steel sheet may be retained in the atmospheric air within the temperature range of 40° C. or higher and 70° C. or lower, for 72 h or longer and 350 h or shorter. Through such retention, it now becomes possible to form an aggregate of carbon solid-soluted in the ferrite crystal grain. The aggregate of carbon is an article formed by several carbon atoms aggregated in the ferrite crystal grain. Formation of such aggregate of carbon can further promote formation of carbide in the annealing step in the succeeding stage. As a consequence, mobility of dislocation in the annealed steel sheet may further be improved, and thereby formability of the annealed steel sheet may further be improved.

Moreover, the thus obtained steel sheet for carburizing may be, for example, subjected to cold working as a post-process. Further, the thus cold-worked steel sheet for carburizing may be subjected to carburization heat treatment, typically within a carbon potential range of 0.4 to 1.0 mass %. Conditions for the carburization heat treatment are not specifically limited, and may be appropriately controlled so as to obtain desired characteristics. For example, the steel sheet for carburizing may be heated up to a temperature that corresponds to the austenitic single phase, carburized, and then cooled naturally down to room temperature; or may be cooled once down to room temperature, reheated, and then quickly quenched. Furthermore, for the purpose of controlling the strength, the entire portion or part of the member may be tempered. Alternatively, the steel sheet may be plated on the surface for the purpose of obtaining a rust-proofing effect, or may be subjected to shot peening on the surface for the purpose of improving fatigue characteristics.

Examples

Next, examples of the present invention will be explained. Note that conditions described in examples are merely exemplary conditions employed in order to confirm feasibility and effects of the present invention. The present invention is not limited to these exemplary conditions. The present invention can employ various conditions without departing from the spirit of the present invention, insofar as the purpose of the present invention will be achieved.

Test Examples

Steel materials having chemical compositions listed in Table 1 below were hot-rolled (and cold-rolled) according to conditions listed in Table 2, and then annealed, to obtain the steel sheets for carburizing. Note that, the hot-rolling according to the conditions listed in Table 2 below was followed by retention in the atmospheric air at 55° C. for 105 hours, and by annealing according to conditions listed in Table 2. In Table 1 and Table 2, the underlines are used to indicate deviation from the scope of invention.

TABLE 1

| No. | Chemical Ingredients of Matrix Steel Sheet (in mass %, Balance is Fe and Impurities.) | | | | | | | | | | | |
|---|---|---|---|---|---|---|---|---|---|---|---|---|
| | C | Si | Mn | P | S | sol. Al | N | Cr | Mo | Ni | Cu | Co |
| 1 | 0.03 | 0.010 | 0.20 | 0.014 | 0.0036 | 0.0130 | 0.0050 | 0.030 | 0.842 | 0.000 | 0.000 | 0.000 |
| 2 | 0.07 | 0.010 | 0.40 | 0.017 | 0.0055 | 0.0150 | 0.0046 | 0.020 | 0.864 | 0.000 | 0.000 | 0.000 |
| 3 | 0.15 | 0.010 | 0.70 | 0.012 | 0.0042 | 0.0110 | 0.0057 | 0.020 | 0.017 | 0.000 | 0.000 | 0.000 |
| 4 | 0.06 | 0.100 | 1.60 | 0.013 | 0.0016 | 0.0570 | 0.0034 | 0.200 | 0.036 | 0.000 | 0.000 | 0.000 |
| 5 | 0.08 | 0.100 | 2.10 | 0.010 | 0.0180 | 0.0260 | 0.0050 | 0.000 | 0.000 | 0.000 | 0.000 | 0.000 |
| 6 | 0.13 | 0.030 | 0.76 | 0.007 | 0.0046 | 0.0110 | 0.0057 | 1.480 | 0.017 | 0.000 | 0.000 | 0.000 |
| 7 | 0.01 | 0.010 | 0.58 | 0.018 | 0.0048 | 0.0390 | 0.0079 | 0.000 | 0.000 | 0.000 | 0.000 | 0.000 |
| 8 | 0.17 | 0.020 | 0.48 | 0.015 | 0.0042 | 0.0470 | 0.0099 | 0.000 | 0.000 | 0.000 | 0.000 | 0.000 |
| 9 | 0.21 | 0.020 | 0.50 | 0.016 | 0.0045 | 0.0490 | 0.0114 | 0.000 | 0.000 | 0.000 | 0.000 | 0.000 |
| 10 | 0.28 | 0.030 | 0.62 | 0.018 | 0.0042 | 0.0260 | 0.0094 | 0.000 | 0.000 | 0.000 | 0.000 | 0.000 |
| 11 | 0.42 | 0.020 | 0.65 | 0.017 | 0.0042 | 0.0110 | 0.0088 | 0.000 | 0.000 | 0.000 | 0.000 | 0.000 |
| 12 | 0.08 | 0.001 | 0.39 | 0.016 | 0.0040 | 0.0320 | 0.0101 | 0.000 | 0.000 | 0.000 | 0.000 | 0.000 |
| 13 | 0.07 | 1.220 | 0.52 | 0.014 | 0.0050 | 0.0130 | 0.0061 | 0.000 | 0.000 | 0.000 | 0.000 | 0.000 |
| 14 | 0.07 | 0.010 | 0.004 | 0.014 | 0.0048 | 0.0310 | 0.0068 | 0.000 | 0.000 | 0.000 | 0.000 | 0.000 |
| 15 | 0.09 | 0.030 | 3.61 | 0.016 | 0.0041 | 0.0220 | 0.0071 | 0.000 | 0.000 | 0.000 | 0.000 | 0.000 |
| 16 | 0.11 | 0.010 | 0.66 | 0.015 | 0.0051 | 0.0550 | 0.0102 | 1.410 | 0.000 | 0.000 | 0.000 | 0.000 |
| 17 | 0.11 | 0.020 | 0.62 | 0.017 | 0.0048 | 0.0530 | 0.0081 | 0.000 | 0.591 | 0.000 | 0.000 | 0.000 |
| 18 | 0.09 | 0.020 | 0.66 | 0.014 | 0.0039 | 0.0370 | 0.0089 | 0.000 | 0.000 | 0.450 | 0.000 | 0.000 |
| 19 | 0.10 | 0.010 | 0.42 | 0.017 | 0.0036 | 0.0250 | 0.0120 | 0.000 | 0.000 | 0.000 | 0.740 | 0.000 |
| 20 | 0.08 | 0.030 | 0.69 | 0.017 | 0.0047 | 0.0210 | 0.0090 | 0.000 | 0.000 | 0.000 | 0.000 | 0.640 |
| 21 | 0.08 | 0.020 | 0.38 | 0.014 | 0.0038 | 0.0430 | 0.0071 | 0.000 | 0.000 | 0.000 | 0.000 | 0.000 |
| 22 | 0.08 | 0.030 | 0.35 | 0.016 | 0.0043 | 0.0540 | 0.0092 | 0.000 | 0.000 | 0.000 | 0.000 | 0.000 |
| 23 | 0.11 | 0.010 | 0.54 | 0.018 | 0.0039 | 0.0250 | 0.0084 | 0.000 | 0.000 | 0.000 | 0.000 | 0.000 |
| 24 | 0.08 | 0.030 | 0.42 | 0.018 | 0.0038 | 0.0350 | 0.0110 | 0.000 | 0.000 | 0.000 | 0.000 | 0.000 |
| 25 | 0.09 | 0.020 | 0.63 | 0.016 | 0.0045 | 0.0320 | 0.0056 | 0.000 | 0.000 | 0.000 | 0.000 | 0.000 |
| 26 | 0.10 | 0.020 | 0.50 | 0.018 | 0.0049 | 0.0400 | 0.0091 | 0.000 | 0.000 | 0.000 | 0.000 | 0.000 |
| 27 | 0.11 | 0.020 | 0.54 | 0.016 | 0.0051 | 0.0340 | 0.0099 | 0.000 | 0.000 | 0.000 | 0.000 | 0.000 |
| 28 | 0.11 | 0.030 | 0.54 | 0.016 | 0.0050 | 0.0410 | 0.0102 | 0.000 | 0.000 | 0.000 | 0.000 | 0.000 |
| 29 | 0.08 | 0.006 | 0.38 | 0.016 | 0.0056 | 0.0153 | 0.0048 | 0.000 | 0.000 | 0.000 | 0.000 | 0.000 |
| 30 | 0.07 | 0.450 | 0.40 | 0.018 | 0.0058 | 0.0150 | 0.0043 | 0.000 | 0.000 | 0.000 | 0.000 | 0.000 |
| 31 | 0.05 | 0.012 | 0.02 | 0.018 | 0.0056 | 0.0146 | 0.0043 | 0.000 | 0.000 | 0.000 | 0.000 | 0.000 |
| 32 | 0.09 | 0.008 | 2.85 | 0.016 | 0.0052 | 0.0152 | 0.0046 | 0.000 | 0.000 | 0.000 | 0.000 | 0.000 |
| 33 | 0.06 | 0.012 | 0.39 | 0.090 | 0.0053 | 0.0147 | 0.0049 | 0.000 | 0.000 | 0.000 | 0.000 | 0.000 |
| 34 | 0.08 | 0.009 | 0.37 | 0.019 | 0.0890 | 0.0154 | 0.0043 | 0.000 | 0.000 | 0.000 | 0.000 | 0.000 |
| 35 | 0.09 | 0.009 | 0.42 | 0.019 | 0.0051 | 0.0003 | 0.0046 | 0.000 | 0.000 | 0.000 | 0.000 | 0.000 |
| 36 | 0.05 | 0.012 | 0.41 | 0.019 | 0.0059 | 2.9100 | 0.0048 | 0.000 | 0.000 | 0.000 | 0.000 | 0.000 |
| 37 | 0.09 | 0.009 | 0.43 | 0.017 | 0.0052 | 0.0149 | 0.1800 | 0.000 | 0.000 | 0.000 | 0.000 | 0.000 |
| 38 | 0.05 | 0.010 | 0.42 | 0.016 | 0.0052 | 0.0153 | 0.0044 | 0.006 | 0.000 | 0.000 | 0.000 | 0.000 |
| 39 | 0.09 | 0.010 | 0.42 | 0.019 | 0.0057 | 0.0151 | 0.0049 | 2.950 | 0.000 | 0.000 | 0.000 | 0.000 |
| 40 | 0.08 | 0.010 | 0.36 | 0.018 | 0.0051 | 0.0150 | 0.0043 | 0.000 | 0.006 | 0.000 | 0.000 | 0.000 |
| 41 | 0.07 | 0.008 | 0.38 | 0.016 | 0.0057 | 0.0151 | 0.0047 | 0.000 | 0.900 | 0.000 | 0.000 | 0.000 |
| 42 | 0.08 | 0.010 | 0.36 | 0.017 | 0.0051 | 0.0148 | 0.0048 | 0.000 | 0.000 | 0.020 | 0.000 | 0.000 |
| 43 | 0.08 | 0.009 | 0.44 | 0.017 | 0.0051 | 0.0153 | 0.0043 | 0.000 | 0.000 | 2.860 | 0.000 | 0.000 |
| 44 | 0.06 | 0.011 | 0.42 | 0.018 | 0.0059 | 0.0152 | 0.0046 | 0.000 | 0.000 | 0.000 | 0.002 | 0.000 |
| 45 | 0.09 | 0.012 | 0.37 | 0.019 | 0.0053 | 0.0146 | 0.0048 | 0.000 | 0.000 | 0.000 | 1.860 | 0.000 |
| 46 | 0.06 | 0.012 | 0.37 | 0.018 | 0.0052 | 0.0147 | 0.0049 | 0.000 | 0.000 | 0.000 | 0.000 | 0.003 |
| 47 | 0.05 | 0.009 | 0.43 | 0.015 | 0.0052 | 0.0147 | 0.0044 | 0.000 | 0.000 | 0.000 | 0.000 | 1.960 |
| 48 | 0.05 | 0.012 | 0.44 | 0.018 | 0.0051 | 0.0149 | 0.0044 | 0.000 | 0.000 | 0.000 | 0.000 | 0.000 |
| 49 | 0.06 | 0.010 | 0.43 | 0.015 | 0.0052 | 0.0154 | 0.0046 | 0.000 | 0.000 | 0.000 | 0.000 | 0.000 |
| 50 | 0.05 | 0.010 | 0.43 | 0.018 | 0.0058 | 0.0148 | 0.0043 | 0.000 | 0.000 | 0.000 | 0.000 | 0.000 |
| 51 | 0.05 | 0.012 | 0.42 | 0.019 | 0.0055 | 0.0150 | 0.0047 | 0.000 | 0.000 | 0.000 | 0.000 | 0.000 |
| 52 | 0.05 | 0.011 | 0.40 | 0.016 | 0.0059 | 0.0153 | 0.0048 | 0.000 | 0.000 | 0.000 | 0.000 | 0.000 |
| 53 | 0.06 | 0.010 | 0.39 | 0.018 | 0.0051 | 0.0146 | 0.0049 | 0.000 | 0.000 | 0.000 | 0.000 | 0.000 |
| 54 | 0.09 | 0.012 | 0.37 | 0.017 | 0.0054 | 0.0152 | 0.0049 | 0.000 | 0.000 | 0.000 | 0.000 | 0.000 |
| 55 | 0.07 | 0.012 | 0.40 | 0.018 | 0.0055 | 0.0153 | 0.0044 | 0.000 | 0.000 | 0.000 | 0.000 | 0.000 |
| 56 | 0.08 | 0.010 | 0.38 | 0.018 | 0.0052 | 0.0149 | 0.0043 | 0.000 | 0.000 | 0.000 | 0.000 | 0.000 |
| 57 | 0.06 | 0.008 | 0.41 | 0.015 | 0.0055 | 0.0146 | 0.0047 | 0.000 | 0.000 | 0.000 | 0.000 | 0.000 |
| 56 | 0.09 | 0 011 | 0.42 | 0.018 | 0.0058 | 0.0153 | 0.0045 | 0.000 | 0.000 | 0.000 | 0.000 | 0.000 |
| 59 | 0.09 | 0.012 | 0.41 | 0.015 | 0.0057 | 0.0150 | 0.0046 | 0.000 | 0.000 | 0.000 | 0.000 | 0.000 |

| No. | Chemical Ingredients of Matrix Steel Sheet (in mass %, Balance is Fe and Impurities.) | | | | | | | | | |
|---|---|---|---|---|---|---|---|---|---|---|
| | Nb | Ti | V | B | Sn | W | Ca | REM | $Ac_t$ (° C.) | Remark |
| 1 | 0.000 | 0.009 | 0.0000 | 0.0004 | 0.000 | 0.000 | 0.000 | 0.00 | 765 | |
| 2 | 0.000 | 0.008 | 0.0000 | 0.0003 | 0.000 | 0.000 | 0.000 | 0.00 | 762 | |
| 3 | 0.000 | 0.004 | 0.0000 | 0.0001 | 0.000 | 0.000 | 0.000 | 0.00 | 738 | |
| 4 | 0.000 | 0.005 | 0.0000 | 0.0002 | 0.000 | 0.000 | 0.000 | 0.00 | 742 | |
| 5 | 0.000 | 0.000 | 0.0000 | 0.0000 | 0.000 | 0.000 | 0.000 | 0.00 | 722 | |
| 6 | 0.000 | 0.004 | 0.0000 | 0.0001 | 0.000 | 0.000 | 0.000 | 0.00 | 773 | |
| 7 | 0.000 | 0.000 | 0.0000 | 0.0000 | 0.000 | 0.000 | 0.000 | 0.00 | 737 | Comparative steel |
| 8 | 0.000 | 0.000 | 0.0000 | 0.0000 | 0.000 | 0.000 | 0.000 | 0.00 | 733 | |

TABLE 1-continued

| | | | | | | | | | | |
|---|---|---|---|---|---|---|---|---|---|---|
| 9 | 0.000 | 0.000 | 0.0000 | 0.0000 | 0.000 | 0.000 | 0.000 | 0.00 | 731 | |
| 10 | 0.000 | 0.000 | 0.0000 | 0.0000 | 0.000 | 0.000 | 0.000 | 0.00 | 732 | |
| 11 | 0.000 | 0.000 | 0.0000 | 0.0000 | 0.000 | 0.000 | 0.000 | 0.00 | 731 | Comparative steel |
| 12 | 0.000 | 0.000 | 0.0000 | 0.0000 | 0.000 | 0.000 | 0.000 | 0.00 | 739 | Comparative steel |
| 13 | 0.000 | 0.000 | 0.0000 | 0.0000 | 0.000 | 0.000 | 0.000 | 0.00 | 762 | Comparative steel |
| 14 | 0.000 | 0.000 | 0.0000 | 0.0000 | 0.000 | 0.000 | 0.000 | 0.00 | 744 | Comparative steel |
| 15 | 0.000 | 0.000 | 0.0000 | 0.0000 | 0.000 | 0.000 | 0.000 | 0.00 | 703 | Comparative steel |
| 16 | 0.000 | 0.000 | 0.0000 | 0.0000 | 0.000 | 0.000 | 0.000 | 0.00 | 765 | |
| 17 | 0.000 | 0.000 | 0.0000 | 0.0000 | 0.000 | 0.000 | 0.000 | 0.00 | 745 | |
| 18 | 0.000 | 0.000 | 0.0000 | 0.0000 | 0.000 | 0.000 | 0.000 | 0.00 | 724 | |
| 19 | 0.000 | 0.000 | 0.0000 | 0.0000 | 0.000 | 0.000 | 0.000 | 0.00 | 722 | |
| 20 | 0.000 | 0.000 | 0.0000 | 0.0000 | 0.000 | 0.000 | 0.000 | 0.00 | 738 | |
| 21 | 0.078 | 0.000 | 0.0000 | 0.0000 | 0.000 | 0.000 | 0.000 | 0.00 | 755 | |
| 22 | 0.000 | 0.032 | 0.0000 | 0.0000 | 0.000 | 0.000 | 0.000 | 0.00 | 736 | |
| 23 | 0.000 | 0.000 | 0.0510 | 0.0000 | 0.000 | 0.000 | 0.000 | 0.00 | 736 | |
| 24 | 0.000 | 0.000 | 0.0000 | 0.0009 | 0.000 | 0.000 | 0.000 | 0.00 | 738 | |
| 25 | 0.000 | 0.000 | 0.0000 | 0.0000 | 0.210 | 0.000 | 0.000 | 0.00 | 736 | |
| 26 | 0.000 | 0.000 | 0.0000 | 0.0000 | 0.000 | 0.280 | 0.000 | 0.00 | 736 | |
| 27 | 0.000 | 0.000 | 0.0000 | 0.0000 | 0.000 | 0.000 | 0.005 | 0.00 | 736 | |
| 28 | 0.000 | 0.000 | 0.0000 | 0.0000 | 0.000 | 0.000 | 0.000 | 0.14 | 735 | |
| 29 | 0.000 | 0.008 | 0.0000 | 0.0003 | 0.000 | 0.000 | 0.000 | 0.00 | 741 | |
| 30 | 0.000 | 0.008 | 0.0000 | 0.0003 | 0.000 | 0.000 | 0.000 | 0.00 | 749 | |
| 31 | 0.000 | 0.008 | 0.0000 | 0.0003 | 0.000 | 0.000 | 0.000 | 0.00 | 747 | |
| 32 | 0.000 | 0.008 | 0.0000 | 0.0003 | 0.000 | 0.000 | 0.000 | 0.00 | 713 | |
| 33 | 0.000 | 0.008 | 0.0000 | 0.0003 | 0.000 | 0.000 | 0.000 | 0.00 | 742 | |
| 34 | 0.000 | 0.008 | 0.0000 | 0.0003 | 0.000 | 0.000 | 0.000 | 0.00 | 742 | |
| 35 | 0.000 | 0.008 | 0.0000 | 0.0003 | 0.000 | 0.000 | 0.000 | 0.00 | 743 | |
| 36 | 0.000 | 0.008 | 0.0000 | 0.0003 | 0.000 | 0.000 | 0.000 | 0.00 | 252 | |
| 37 | 0.000 | 0.008 | 0.0000 | 0.0003 | 0.000 | 0.000 | 0.000 | 0.00 | 741 | |
| 38 | 0.000 | 0.008 | 0.0000 | 0.0003 | 0.000 | 0.000 | 0.000 | 0.00 | 742 | |
| 39 | 0.000 | 0.008 | 0.0000 | 0.0003 | 0.000 | 0.000 | 0.000 | 0.00 | 812 | |
| 40 | 0.000 | 0.008 | 0.0000 | 0.0003 | 0.000 | 0.000 | 0.000 | 0.00 | 742 | |
| 41 | 0.000 | 0.008 | 0.0000 | 0.0003 | 0.000 | 0.000 | 0.000 | 0.00 | 762 | |
| 42 | 0.000 | 0.008 | 0.0000 | 0.0003 | 0.000 | 0.000 | 0.000 | 0.00 | 741 | |
| 43 | 0.000 | 0.008 | 0.0000 | 0.0003 | 0.000 | 0.000 | 0.000 | 0.00 | 675 | |
| 44 | 0.000 | 0.008 | 0.0000 | 0.0003 | 0.000 | 0.000 | 0.000 | 0.00 | 742 | |
| 45 | 0.000 | 0.008 | 0.0000 | 0.0003 | 0.000 | 0.000 | 0.000 | 0.00 | 699 | |
| 46 | 0.000 | 0.008 | 0.0000 | 0.0003 | 0.000 | 0.000 | 0.000 | 0.00 | 742 | |
| 47 | 0.000 | 0.008 | 0.0000 | 0.0003 | 0.000 | 0.000 | 0.000 | 0.00 | 742 | |
| 48 | 0.020 | 0.008 | 0.0000 | 0.0003 | 0.000 | 0.000 | 0.000 | 0.00 | 746 | |
| 49 | 0.130 | 0.008 | 0.0000 | 0.0003 | 0.000 | 0.000 | 0.000 | 0.00 | 772 | |
| 50 | 0.000 | 0.015 | 0.0000 | 0.0003 | 0.000 | 0.000 | 0.000 | 0.00 | 742 | |
| 51 | 0.000 | 0.140 | 0.0000 | 0.0003 | 0.000 | 0.000 | 0.000 | 0.00 | 741 | |
| 52 | 0.000 | 0.008 | 0.0007 | 0.0003 | 0.000 | 0.000 | 0.000 | 0.00 | 742 | |
| 53 | 0.000 | 0.008 | 0.8900 | 0.0003 | 0.000 | 0.000 | 0.000 | 0.00 | 707 | |
| 54 | 0.000 | 0.008 | 0.0000 | 0.0006 | 0.000 | 0.000 | 0.000 | 0.00 | 741 | |
| 55 | 0.000 | 0.008 | 0.0000 | 0.0090 | 0.000 | 0.000 | 0.000 | 0.00 | 734 | |
| 56 | 0.000 | 0.008 | 0.0000 | 0.0003 | 0.940 | 0.000 | 0.000 | 0.00 | 742 | |
| 57 | 0.000 | 0.008 | 0.0000 | 0.0003 | 0.000 | 0.970 | 0.000 | 0.00 | 742 | |
| 56 | 0.000 | 0.008 | 0.0000 | 0.0003 | 0.000 | 0.000 | 0.009 | 0.00 | 741 | |
| 59 | 0.000 | 0.008 | 0.0000 | 0.0003 | 0.000 | 0.000 | 0.000 | 0.29 | 741 | |

TABLE 2

| | | Hot-rolling | | | | | |
|---|---|---|---|---|---|---|---|
| No. | Steel No. | Rolling temperature in second last pass prior to finish rolling (° C.) | Draft in second last pass prior to finish rolling (%) | Finish rolling temperature (° C.) | Draft in finish rolling (%) | Winding temperature (° C.) | Cold-rolling Draft in cold-rolling (%) |
| 1 | 1 | 926 | 22 | 864 | 9 | 620 | — |
| 2 | 2 | 922 | 19 | 876 | 9 | 596 | — |
| 3 | 3 | 914 | 17 | 851 | 7 | 627 | — |
| 4 | 4 | 927 | 21 | 877 | 7 | 614 | — |
| 5 | 5 | 985 | 18 | 878 | 7 | 556 | — |
| 6 | 6 | 991 | 18 | 905 | 7 | 410 | — |
| 7 | 7 | 902 | 22 | 849 | 7 | 622 | — |
| 8 | 8 | 929 | 18 | 865 | 8 | 552 | — |
| 9 | 9 | 906 | 17 | 861 | 7 | 695 | — |

TABLE 2-continued

| | | | | | | | |
|---|---|---|---|---|---|---|---|
| 10 | 10 | 900 | 16 | 869 | 9 | 565 | — |
| 11 | 11 | 909 | 22 | 866 | 9 | 596 | — |
| 12 | 12 | 925 | 19 | 871 | 8 | 625 | — |
| 13 | 13 | 913 | 17 | 851 | 9 | 628 | — |
| 14 | 14 | 910 | 22 | 845 | 8 | 613 | — |
| 15 | 15 | 906 | 16 | 858 | 8 | 695 | — |
| 16 | 16 | 910 | 20 | 841 | 9 | 649 | — |
| 17 | 17 | 906 | 21 | 855 | 9 | 587 | — |
| 18 | 18 | 909 | 17 | 871 | 9 | 665 | — |
| 19 | 19 | 932 | 20 | 839 | 9 | 568 | — |
| 20 | 20 | 947 | 18 | 857 | 7 | 583 | — |
| 21 | 21 | 924 | 16 | 858 | 7 | 682 | — |
| 22 | 22 | 937 | 17 | 846 | 7 | 588 | — |
| 23 | 23 | 925 | 21 | 835 | 9 | 609 | — |
| 24 | 24 | 931 | 22 | 837 | 7 | 666 | — |
| 25 | 25 | 912 | 17 | 846 | 7 | 611 | — |
| 26 | 26 | 937 | 21 | 852 | 8 | 565 | — |
| 27 | 27 | 939 | 20 | 871 | 9 | 554 | — |
| 28 | 28 | 903 | 20 | 860 | 9 | 679 | — |
| 29 | 29 | 919 | 19 | 879 | 8 | 597 | — |
| 30 | 30 | 920 | 16 | 877 | 10 | 596 | — |
| 31 | 31 | 925 | 18 | 866 | 8 | 614 | — |
| 32 | 32 | 920 | 17 | 886 | 10 | 604 | — |
| 33 | 33 | 912 | 19 | 884 | 8 | 612 | — |
| 34 | 34 | 927 | 18 | 874 | 10 | 615 | — |
| 35 | 35 | 930 | 18 | 868 | 8 | 600 | — |
| 36 | 36 | 932 | 21 | 879 | 8 | 600 | — |
| 37 | 37 | 916 | 21 | 866 | 8 | 600 | — |
| 38 | 38 | 914 | 16 | 875 | 9 | 609 | — |
| 39 | 39 | 915 | 22 | 869 | 9 | 613 | — |
| 40 | 40 | 926 | 20 | 867 | 10 | 606 | — |
| 41 | 41 | 914 | 21 | 870 | 8 | 607 | — |
| 42 | 42 | 924 | 19 | 882 | 10 | 598 | — |
| 43 | 43 | 929 | 18 | 871 | 10 | 590 | — |
| 44 | 44 | 925 | 18 | 867 | 10 | 611 | — |
| 45 | 45 | 930 | 20 | 869 | 10 | 593 | — |
| 46 | 46 | 918 | 17 | 875 | 10 | 613 | — |
| 47 | 47 | 924 | 21 | 876 | 10 | 608 | — |
| 48 | 48 | 913 | 20 | 870 | 8 | 595 | — |
| 49 | 49 | 914 | 22 | 884 | 9 | 599 | — |
| 50 | 50 | 930 | 18 | 871 | 10 | 593 | — |
| 51 | 51 | 916 | 18 | 868 | 9 | 609 | — |
| 52 | 52 | 929 | 19 | 871 | 10 | 601 | — |
| 53 | 53 | 929 | 22 | 873 | 8 | 597 | — |
| 54 | 54 | 924 | 17 | 871 | 10 | 601 | — |
| 55 | 55 | 914 | 21 | 878 | 10 | 613 | — |
| 56 | 56 | 923 | 18 | 883 | 10 | 595 | — |
| 57 | 57 | 913 | 18 | 867 | 8 | 605 | — |
| 58 | 58 | 920 | 16 | 874 | 9 | 602 | — |
| 59 | 59 | 912 | 20 | 872 | 8 | 588 | — |
| 60 | 2 | 1031 | 20 | 838 | 7 | 571 | — |
| 61 | 2 | 922 | 21 | 860 | 9 | 662 | — |
| 62 | 2 | 819 | 17 | 849 | 7 | 615 | — |
| 63 | 2 | 909 | 38 | 850 | 7 | 678 | — |
| 64 | 2 | 915 | 22 | 857 | 7 | 577 | — |
| 65 | 2 | 914 | 1 | 858 | 7 | 673 | — |
| 66 | 2 | 944 | 17 | 921 | 7 | 654 | — |
| 67 | 2 | 915 | 21 | 837 | 9 | 594 | — |
| 68 | 2 | 930 | 21 | 781 | 9 | 648 | — |
| 69 | 2 | 915 | 20 | 867 | 7 | 657 | — |
| 70 | 2 | 920 | 20 | 855 | 2 | 662 | — |
| 71 | 2 | 906 | 17 | 841 | 7 | 741 | — |
| 72 | 2 | 923 | 17 | 868 | 9 | 694 | — |
| 73 | 2 | 900 | 16 | 851 | 9 | 688 | 51 |
| 74 | 2 | 922 | 21 | 860 | 9 | 562 | — |
| 75 | 2 | 915 | 22 | 854 | 9 | 688 | — |
| 76 | 2 | 912 | 21 | 858 | 7 | 586 | — |
| 77 | 2 | 932 | 18 | 875 | 7 | 569 | — |
| 78 | 2 | 930 | 18 | 872 | 7 | 585 | — |
| 79 | 2 | 914 | 18 | 863 | 8 | 677 | — |
| 80 | 2 | 908 | 20 | 853 | 9 | 639 | — |
| 81 | 2 | 907 | 18 | 853 | 8 | 583 | — |
| 82 | 2 | 935 | 18 | 870 | 8 | 687 | — |
| 83 | 2 | 931 | 16 | 878 | 9 | 684 | — |
| 84 | 2 | 909 | 18 | 862 | 8 | 671 | — |
| 85 | 2 | 917 | 22 | 862 | 8 | 566 | — |
| 86 | 2 | 925 | 16 | 861 | 7 | 644 | — |
| 87 | 2 | 912 | 17 | 863 | 8 | 571 | — |
| 88 | 2 | 971 | 23 | 861 | 9 | 662 | — |
| 89 | 2 | 908 | 19 | 865 | 9 | 666 | — |

TABLE 2-continued

| | | | | | | | |
|---|---|---|---|---|---|---|---|
| 90 | 2 | 911 | 24 | 852 | 7 | 580 | — |
| 91 | 2 | 911 | 16 | 862 | 8 | 575 | — |
| 92 | 2 | 916 | 22 | 915 | 9 | 591 | — |
| 93 | 2 | 919 | 22 | 804 | 9 | 590 | — |
| 94 | 2 | 916 | 18 | 869 | 6 | 655 | — |
| 95 | 2 | 906 | 20 | 858 | 8 | 637 | — |
| 96 | 2 | 911 | 18 | 853 | 10 | 636 | — |

| | Spherodizing annealing | | | | | | |
|---|---|---|---|---|---|---|---|
| No. | Nitrogen concentration in annealing atmosphere (%) | Average heating rate (° C./h) | Heating temperature (° C.) | Retention time (h) | Average cooling rate (° C./h) | Thickness (mm) | Remark |
| 1 | 4 | 31 | 655 | 33 | 34 | 5.3 | Example |
| 2 | 5 | 15 | 656 | 20 | 17 | 5.3 | Example |
| 3 | 12 | 26 | 638 | 48 | 34 | 5.3 | Example |
| 4 | 17 | 30 | 646 | 37 | 36 | 4.3 | Example |
| 5 | 7 | 11 | 730 | 4 | 11 | 5.0 | Comparative Example |
| 6 | 5 | 99 | 710 | 33 | 84 | 5.2 | Comparative Example |
| 7 | 12 | 20 | 658 | 43 | 40 | 5.0 | Comparative Example |
| 8 | 15 | 44 | 658 | 71 | 29 | 5.1 | Example |
| 9 | 12 | 32 | 644 | 84 | 33 | 5.4 | Example |
| 10 | 16 | 31 | 641 | 79 | 21 | 5.0 | Example |
| 11 | 14 | 21 | 641 | 68 | 29 | 4.7 | Comparative Example |
| 12 | 7 | 44 | 658 | 63 | 28 | 5.5 | Comparative Example |
| 13 | 8 | 35 | 676 | 30 | 40 | 4.3 | Comparative Example |
| 14 | 9 | 24 | 660 | 47 | 26 | 4.8 | Comparative Example. |
| 15 | 11 | 38 | 615 | 20 | 44 | 4.2 | Comparative Example |
| 16 | 9 | 33 | 678 | 80 | 34 | 3.9 | Example |
| 17 | 16 | 15 | 667 | 83 | 40 | 5.3 | Example |
| 18 | 16 | 26 | 606 | 63 | 28 | 4.2 | Example |
| 19 | 17 | 15 | 636 | 21 | 21 | 5.1 | Example |
| 20 | 14 | 20 | 648 | 79 | 23 | 3.9 | Example |
| 21 | 7 | 28 | 674 | 33 | 16 | 4.4 | Example |
| 22 | 16 | 24 | 652 | 30 | 32 | 4.8 | Example |
| 23 | 17 | 28 | 646 | 29 | 36 | 5.0 | Example |
| 24 | 17 | 22 | 656 | 85 | 31 | 5.5 | Example |
| 25 | 5 | 24 | 653 | 59 | 43 | 5.1 | Example |
| 26 | 9 | 35 | 650 | 56 | 35 | 5.2 | Example |
| 27 | 4 | 31 | 653 | 19 | 39 | 4.3 | Example |
| 28 | 14 | 43 | 661 | 60 | 31 | 5.4 | Example |
| 29 | 11 | 22 | 661 | 44 | 22 | 5.5 | Example |
| 30 | 10 | 29 | 663 | 38 | 33 | 5.6 | Example |
| 31 | 12 | 26 | 656 | 31 | 25 | 4.8 | Example |
| 32 | 4 | 23 | 662 | 38 | 25 | 5.1 | Example |
| 33 | 6 | 26 | 665 | 41 | 28 | 5.1 | Example |
| 34 | 10 | 30 | 651 | 37 | 27 | 5.5 | Example |
| 35 | 6 | 23 | 652 | 38 | 25 | 4.9 | Example |
| 36 | 15 | 27 | 658 | 39 | 35 | 5.3 | Example |
| 37 | 7 | 28 | 658 | 45 | 33 | 4.9 | Example |
| 38 | 14 | 22 | 662 | 30 | 26 | 4.9 | Example |
| 39 | 12 | 30 | 666 | 43 | 23 | 5.2 | Example |
| 40 | 15 | 23 | 652 | 41 | 37 | 5.4 | Example |
| 41 | 6 | 23 | 654 | 46 | 31 | 5.1 | Example |
| 42 | 7 | 23 | 648 | 39 | 36 | 5.5 | Example |
| 43 | 4 | 22 | 665 | 43 | 32 | 5.1 | Example |
| 44 | 13 | 22 | 659 | 32 | 26 | 5.4 | Example |
| 45 | 9 | 26 | 656 | 39 | 26 | 5.5 | Example |
| 46 | 9 | 30 | 655 | 49 | 34 | 5.8 | Example |
| 47 | 5 | 23 | 650 | 38 | 32 | 5.4 | Example |
| 48 | 4 | 26 | 658 | 43 | 35 | 5.2 | Example |

TABLE 2-continued

| | | | | | | | |
|---|---|---|---|---|---|---|---|
| 49 | 8 | 27 | 664 | 46 | 23 | 5.3 | Example |
| 50 | 10 | 25 | 655 | 31 | 26 | 5.4 | Example |
| 51 | 6 | 25 | 659 | 45 | 26 | 5.2 | Example |
| 52 | 8 | 21 | 649 | 36 | 32 | 5.7 | Example |
| 53 | 9 | 21 | 666 | 48 | 37 | 4.9 | Example |
| 54 | 5 | 20 | 650 | 36 | 22 | 5.1 | Example |
| 55 | 7 | 22 | 660 | 50 | 31 | 5.3 | Example |
| 56 | 4 | 21 | 646 | 32 | 31 | 5.5 | Example |
| 57 | 14 | 29 | 651 | 43 | 27 | 4.8 | Example |
| 58 | 6 | 26 | 656 | 44 | 28 | 5.4 | Example |
| 59 | 6 | 21 | 652 | 37 | 23 | 4.8 | Example |
| 60 | 15 | 22 | 659 | 20 | 27 | 5.2 | Comparative Example |
| 61 | 17 | 42 | 651 | 24 | 26 | 5.0 | Example |
| 62 | 6 | 37 | 667 | 25 | 38 | 3.9 | Comparative Example |
| 63 | 12 | 21 | 662 | 49 | 31 | 5.1 | Comparative Example |
| 64 | 8 | 24 | 664 | 34 | 38 | 3.5 | Example |
| 65 | 8 | 40 | 660 | 76 | 35 | 4.7 | Comparative Example |
| 66 | 6 | 42 | 671 | 26 | 44 | 3.8 | Comparative Example |
| 67 | 10 | 34 | 663 | 51 | 15 | 4.4 | Example |
| 68 | 15 | 29 | 652 | 45 | 30 | 4.2 | Comparative Example |
| 69 | 17 | 38 | 654 | 47 | 35 | 5.4 | Example |
| 70 | 5 | 25 | 654 | 53 | 36 | 3.5 | Comparative Example |
| 71 | 7 | 23 | 657 | 61 | 42 | 4.7 | Comparative Example |
| 72 | 7 | 24 | 653 | 22 | 32 | 5.4 | Example |
| 73 | 6 | 34 | 651 | 50 | 25 | 2.7 | Example |
| 74 | 39 | 29 | 654 | 37 | 27 | 4.3 | Comparative Example |
| 75 | 5 | 40 | 670 | 45 | 22 | 4.4 | Example |
| 76 | 6 | 124 | 656 | 75 | 33 | 4.6 | Comparative Example |
| 77 | 15 | 21 | 654 | 80 | 20 | 3.9 | Example |
| 78 | 7 | 2 | 665 | 70 | 41 | 4.6 | Comparative Example |
| 79 | 9 | 19 | 771 | 56 | 34 | 4.5 | Comparative Example |
| 80 | 17 | 42 | 652 | 74 | 18 | 4.2 | Example |
| 81 | 11 | 32 | 614 | 68 | 22 | 4.5 | Example |
| 82 | 10 | 35 | 670 | 134 | 31 | 5.5 | Comparative Example |
| 83 | 10 | 24 | 661 | 67 | 31 | 5.2 | Example |
| 84 | 13 | 23 | 654 | 2 | 27 | 5.4 | Comparative Example |
| 85 | 13 | 32 | 652 | 82 | 126 | 4.4 | Comparative Example |
| 86 | 10 | 20 | 655 | 44 | 34 | 4.6 | Example |
| 87 | 9 | 19 | 666 | 37 | 3 | 5.2 | Comparative Example |
| 88 | 18 | 44 | 646 | 19 | 31 | 4.9 | Example |
| 89 | 14 | 41 | 648 | 23 | 27 | 5.0 | Example |
| 90 | 6 | 26 | 668 | 37 | 36 | 3.5 | Example |
| 91 | 11 | 25 | 664 | 29 | 43 | 3.6 | Example |
| 92 | 9 | 32 | 662 | 52 | 12 | 4.5 | Example |
| 93 | 13 | 31 | 668 | 55 | 12 | 4.4 | Example |
| 94 | 16 | 41 | 659 | 49 | 36 | 5.6 | Example |

TABLE 2-continued

| | | | | | | | |
|---|---|---|---|---|---|---|---|
| 95 | 17 | 45 | 751 | 75 | 16 | 4.1 | Example |
| 96 | 20 | 39 | 605 | 73 | 20 | 4.0 | Example |

For each of the thus obtained steel sheets for carburizing, measured were (1) average value of X-ray random intensity ratio assignable to the orientation group of ferrite crystal grain ranging from {100}<011> to {223}<110>; (2) percentage of the number of carbides with an aspect ratio of 2.0 or smaller, among from the total carbides; (3) percentage of the number of carbides formed within the ferrite crystal grains among from the total carbides; and (4) the average equivalent circle diameter of carbide, according to the methods described previously.

Also in order to evaluate cold workability of each of the thus obtained steel sheets for carburizing, hole expansion test was carried out in compliance with JIS Z 2256 (Metallic materials—Hole expanding test). A test specimen was sampled from each of the obtained steel sheets for carburizing at a freely selectable position, and hole expansion rate was calculated according to the method and equation specified in JIS Z 2256. In this test example, the cases where the hole expansion rate was found to be 80% or larger were considered to represent good extreme deformability, and accepted as "examples". Meanwhile, those causing cracks when the specimens for hole expansion test were manufactured (punched) were denoted by "-".

As a reference, also ideal critical diameter, which is an index for hardenability after carburizing, was calculated. The ideal critical diameter $D_i$ is an index calculated from ingredients of the steel sheet, and may be determined using the equation (201) according to Grossmann/Hollomon, Jaffe's method. The larger the value of ideal critical diameter a, the more excellent the hardenability.

[Math. 3]

$$D_i=(6.77\times[C]^{0.5})\times(1+0.64\times[Si])\times(1+4.1\times[Mn])\times(1+2.83\times[P])\times(1-0.62\times[S])\times(1+0.27\times[Cu])\times(1+0.52\times[Ni])\times(1+2.33\times[Cr])\times(1+3.14\times[mo])\times X$$

for [B]=0:X=1 for [B]>0:X=1+1.5×(0.9−[C]) Equation 201)

Microstructures and characteristics of the individual steel sheets for carburizing thus obtained were collectively summarized in Table 3 below.

TABLE 3

| | | Microstructure | | | | | | |
|---|---|---|---|---|---|---|---|---|
| No. | Steel No. | Average of X-ray random intensity ratio (—) | Percentage of number of carbides with aspect ratio of 2.0 or smaller (%) | Percentage of number of carbides within ferrite crystal grain (%) | Average circle equivalent diameter of carbide (μm) | Mechanical characteristics Hole expansion rate (%) | Hardenability Ideal critical diameter (—) | Remark |
| 1 | 1 | 4.8 | 97 | 75 | 0.64 | 117 | 20.0 | Example |
| 2 | 2 | 5.4 | 97 | 81 | 0.63 | 110 | 43.4 | Example |
| 3 | 3 | 3.8 | 86 | 83 | 0.53 | 95 | 24.7 | Example |
| 4 | 4 | 5.4 | 91 | 87 | 0.69 | 115 | 137.2 | Example |
| 5 | 5 | 8.2 | 89 | 31 | 0.54 | 56 | 19.9 | Comparative Example |
| 6 | 6 | 8.1 | 91 | 89 | 0.64 | 61 | 105.1 | Comparative Example |
| 7 | 7 | 4.7 | 82 | 82 | 0.69 | — | 2.4 | Comparative Example |
| 8 | 8 | 4.4 | 92 | 69 | 0.44 | 95 | 8.7 | Example |
| 9 | 9 | 3.2 | 86 | 68 | 0.44 | 82 | 10.0 | Example |
| 10 | 10 | 4.6 | 85 | 86 | 0.52 | 92 | 13.6 | Example |
| 11 | 11 | 3.4 | 84 | 68 | 7.62 | — | 17.0 | Comparative Example |
| 12 | 12 | 5.3 | 85 | 86 | 6.88 | — | 5.2 | Comparative Example |
| 13 | 13 | 4.1 | 96 | 68 | 6.56 | — | 10.4 | Comparative Example |
| 14 | 14 | 4.8 | 97 | 87 | 6.96 | — | 1.9 | Comparative Example |
| 15 | 15 | 4.0 | 90 | 83 | 7.01 | — | 34.1 | Comparative Example |
| 16 | 16 | 4.5 | 84 | 77 | 0.57 | 84 | 37.3 | Example |
| 17 | 17 | 3.2 | 94 | 74 | 0.41 | 87 | 24.0 | Example |
| 18 | 18 | 4.0 | 88 | 89 | 0.62 | 105 | 9.8 | Example |
| 19 | 19 | 5.2 | 92 | 83 | 0.66 | 108 | 7.4 | Example |
| 20 | 20 | 4.7 | 96 | 82 | 0.74 | 114 | 7.8 | Example |
| 21 | 21 | 5.3 | 84 | 78 | 0.66 | 115 | 5.1 | Example |

TABLE 3-continued

| No. | Steel No. | Microstructure: Average of X-ray random intensity ratio (—) | Microstructure: Percentage of number of carbides with aspect ratio of 2.0 or smaller (%) | Microstructure: Percentage of number of carbides within ferrite crystal grain (%) | Microstructure: Average circle equivalent diameter of carbide (μm) | Mechanical characteristics Hole expansion rate (%) | Hardenability Ideal critical diameter (—) | Remark |
|---|---|---|---|---|---|---|---|---|
| 22 | 22 | 4.4 | 83 | 71 | 0.54 | 109 | 5.0 | Example |
| 23 | 23 | 5.4 | 90 | 76 | 0.55 | 85 | 7.6 | Example |
| 24 | 24 | 4.2 | 97 | 78 | 0.45 | 108 | 12.4 | Example |
| 25 | 25 | 5.1 | 86 | 88 | 0.44 | 117 | 7.7 | Example |
| 26 | 26 | 3.3 | 89 | 86 | 0.46 | 86 | 6.9 | Example |
| 27 | 27 | 4.7 | 82 | 68 | 0.50 | 92 | 7.6 | Example |
| 28 | 28 | 5.1 | 90 | 78 | 0.61 | 93 | 7.7 | Example |
| 29 | 29 | 4.9 | 95 | 77 | 0.81 | 110 | 11.4 | Example |
| 30 | 30 | 5.9 | 93 | 77 | 4.85 | 83 | 14.3 | Example |
| 31 | 31 | 4.9 | 97 | 78 | 0.79 | 112 | 3.9 | Example |
| 32 | 32 | 5.6 | 93 | 77 | 4.78 | 85 | 59.8 | Example |
| 33 | 33 | 5.5 | 93 | 78 | 0.63 | 110 | 12.3 | Example |
| 34 | 34 | 5.6 | 92 | 83 | 0.66 | 109 | 10.8 | Example |
| 35 | 35 | 5.1 | 95 | 81 | 0.81 | 106 | 12.9 | Example |
| 36 | 36 | 5.5 | 94 | 79 | 0.77 | 104 | 9.8 | Example |
| 37 | 37 | 5.7 | 92 | 79 | 0.63 | 86 | 13.1 | Example |
| 38 | 38 | 5.8 | 92 | 82 | 0.58 | 102 | 10.0 | Example |
| 39 | 39 | 5.9 | 95 | 83 | 0.61 | 90 | 101.9 | Example |
| 40 | 40 | 5.7 | 92 | 83 | 0.58 | 114 | 11.4 | Example |
| 41 | 41 | 5.1 | 97 | 82 | 0.61 | 89 | 41.2 | Example |
| 42 | 42 | 5.5 | 94 | 76 | 0.60 | 113 | 11.2 | Example |
| 43 | 43 | 5.6 | 94 | 82 | 0.60 | 91 | 31.3 | Example |
| 44 | 44 | 5.5 | 97 | 83 | 0.59 | 115 | 10.8 | Example |
| 45 | 45 | 5.1 | 95 | 84 | 0.59 | 88 | 18.0 | Example |
| 46 | 46 | 5.0 | 96 | 81 | 0.59 | 112 | 10.0 | Example |
| 47 | 47 | 5.7 | 97 | 79 | 0.68 | 89 | 9.9 | Example |
| 48 | 48 | 5.2 | 92 | 82 | 0.66 | 109 | 10.2 | Example |
| 49 | 49 | 5.4 | 95 | 81 | 0.58 | 91 | 10.8 | Example |
| 50 | 50 | 5.0 | 95 | 78 | 0.66 | 115 | 10.0 | Example |
| 51 | 51 | 5.9 | 94 | 83 | 0.65 | 92 | 9.9 | Example |
| 52 | 52 | 5.2 | 94 | 81 | 0.60 | 106 | 9.5 | Example |
| 53 | 53 | 5.1 | 92 | 83 | 0.65 | 88 | 10.3 | Example |
| 54 | 54 | 5.2 | 96 | 76 | 0.61 | 114 | 11.9 | Example |
| 55 | 55 | 5.4 | 96 | 83 | 0.63 | 91 | 11.2 | Example |
| 56 | 56 | 5.0 | 95 | 77 | 0.67 | 85 | 11.5 | Example |
| 57 | 57 | 5.3 | 95 | 79 | 0.62 | 88 | 10.5 | Example |
| 58 | 58 | 5.0 | 92 | 82 | 0.60 | 90 | 12.9 | Example |
| 59 | 59 | 4.9 | 92 | 83 | 0.61 | 89 | 12.6 | Example |
| 60 | 2 | 8.3 | 90 | 70 | 0.45 | 55 | 43.4 | Comparative Example |
| 61 | 2 | 4.7 | 86 | 86 | 0.40 | 120 | 43.4 | Example |
| 62 | 2 | 8.6 | 95 | 83 | 0.48 | 52 | 43.4 | Comparative Example |
| 63 | 2 | 7.3 | 97 | 81 | 0.59 | 56 | 43.4 | Comparative Example |
| 64 | 2 | 4.5 | 90 | 68 | 0.60 | 114 | 43.4 | Example |
| 65 | 2 | 7.6 | 93 | 69 | 0.62 | 57 | 43.4 | Comparative Example |
| 66 | 2 | 5.4 | 49 | 78 | 0.60 | 42 | 43.4 | Comparative Example |
| 67 | 2 | 5.3 | 84 | 80 | 0.43 | 116 | 43.4 | Example |
| 68 | 2 | 7.7 | 98 | 73 | 0.36 | 52 | 43.4 | Comparative Example |
| 69 | 2 | 4.5 | 88 | 74 | 0.44 | 109 | 43.4 | Example |
| 70 | 2 | 7.3 | 98 | 73 | 0.56 | 58 | 43.4 | Comparative Example |
| 71 | 2 | 5.5 | 66 | 69 | 0.64 | 71 | 43.4 | Comparative Example |
| 72 | 2 | 4.4 | 84 | 89 | 0.58 | 117 | 43.4 | Example |
| 73 | 2 | 4.1 | 85 | 73 | 0.51 | 112 | 43.4 | Example |
| 74 | 2 | 4.1 | 96 | 84 | 6.00 | — | 43.4 | Comparative Example |

TABLE 3-continued

| No. | Steel No. | Microstructure: Average of X-ray random intensity ratio (—) | Microstructure: Percentage of number of carbides with aspect ratio of 2.0 or smaller (%) | Microstructure: Percentage of number of carbides within ferrite crystal grain (%) | Microstructure: Average circle equivalent diameter of carbide (μm) | Mechanical characteristics Hole expansion rate (%) | Hardenability Ideal critical diameter (—) | Remark |
|---|---|---|---|---|---|---|---|---|
| 75 | 2 | 5.5 | 86 | 80 | 0.62 | 114 | 43.4 | Example |
| 76 | 2 | 3.6 | 41 | 75 | 0.65 | 71 | 43.4 | Comparative Example |
| 77 | 2 | 4.5 | 90 | 71 | 0.62 | 115 | 43.4 | Example |
| 78 | 2 | 4.5 | 92 | 72 | 6.05 | — | 43.4 | Comparative Example |
| 79 | 2 | 3.3 | 85 | 36 | 0.52 | 72 | 43.4 | Comparative Example |
| 80 | 2 | 4.8 | 96 | 85 | 0.43 | 119 | 43.4 | Example |
| 81 | 2 | 4.9 | 96 | 78 | 0.44 | 114 | 43.4 | Example |
| 82 | 2 | 4.1 | 88 | 68 | 7.66 | — | 43.4 | Comparative Example |
| 83 | 2 | 5.0 | 92 | 86 | 0.48 | 106 | 43.4 | Example |
| 84 | 2 | 5.2 | 65 | 70 | 0.49 | 71 | 43.4 | Comparative Example |
| 85 | 2 | 4.9 | 71 | 68 | 0.46 | 74 | 43.4 | Comparative Example |
| 86 | 2 | 3.8 | 95 | 82 | 0.49 | 117 | 43.4 | Example |
| 87 | 2 | 4.3 | 88 | 79 | 7.62 | — | 43.4 | Comparative Example |
| 88 | 2 | 6.8 | 93 | 73 | 0.67 | 120 | 43.4 | Example |
| 89 | 2 | 6.7 | 95 | 77 | 0.59 | 109 | 43.4 | Example |
| 90 | 2 | 6.1 | 93 | 80 | 0.61 | 109 | 43.4 | Example |
| 91 | 2 | 6.3 | 90 | 82 | 0.63 | 114 | 43.4 | Example |
| 92 | 2 | 6.4 | 92 | 77 | 0.61 | 100 | 43.4 | Example |
| 93 | 2 | 6.5 | 93 | 74 | 0.62 | 114 | 43.4 | Example |
| 94 | 2 | 6.2 | 96 | 75 | 0.62 | 112 | 43.4 | Example |
| 95 | 2 | 5.1 | 91 | 81 | 0.65 | 103 | 43.4 | Example |
| 96 | 2 | 5.5 | 89 | 64 | 0.66 | 86 | 43.4 | Example |

As is clear from Table 3 above, the steel sheets for carburizing that come under examples of the present invention were found to show hole expansion rates, specified by JIS Z 2256 (Metallic materials—Hole expanding test), of 80% or larger, proving good extreme deformability. Also the ideal critical diameter, described for reference, was found to be 5 or larger, teaching that the steel sheets for carburizing that come under examples of the present invention also excel in hardenability.

Meanwhile, as is clear from Table 3 above, the steel sheets for carburizing that come under comparative examples of the present invention were found to show hole expansion rates of smaller than 80%, proving poor extreme deformability. In particular, No. 7, 11 to 15, 74, 78, 82 and 87 caused cracks when the specimens for hole expansion test were manufactured (punched), making it unable to calculate the hole expansion rate, and proving poor workability.

Although having detailed the preferred embodiments of the present invention, the present invention is not limited to these examples. It is obvious that those having general knowledge in the technical field to which the present invention pertains will easily arrive at various modified examples or revised examples within the scope of technical concept described in claims, and also these examples are naturally understood to come under the technical scope of the present invention.

The invention claimed is:

1. A steel sheet for carburizing comprising, in mass%,

C: more than or equal to 0.02%, and less than 0.30%,

Si: more than or equal to 0.005%, and less than 0.5%,

Mn: more than or equal to 0.01%, and less than 3.0%,

P: less than or equal to 0.1%,

S: less than or equal to 0.1%, sol. A1: more than or equal to 0.0002%, and less than or equal to 3.0%, N: less than or equal to 0.2%, and the balance: Fe and impurities, wherein average value of X-ray random intensity ratio, assignable to an orientation group of ferrite crystal grain ranging from {100}<011>to {223}<110>, is 7.0 or smaller, average equivalent circle diameter of carbide is 5.0 μm or smaller, percentage of number of carbides with an aspect ratio of 2.0 or smaller is 80% or larger relative to the total carbides, and percentage of number of carbides present in the ferrite crystal grain is 60% or larger relative to the total carbides.

2. The steel sheet for carburizing according to claim 1, further comprising, in place of part of the balance Fe, one of, or two or more of, in mass%, Cr: more than or equal to 0.005%, and less than or equal to 3.0%, Mo: more than or equal to 0.005%, and less than or equal to 1.0%, Ni: more than or equal to 0.010%, and less than or equal to 3.0%, Cu: more than or equal to 0.001%, and less than or equal to 2.0%, Co: more than or equal to 0.001%, and less than or equal to 2.0%, Nb: more than or equal to 0.010%, and less than or equal to 0.150%, Ti: more than or equal to 0.010%, and less than or equal to 0.150%, V: more than or equal to 0.0005%, and less than or equal to 1.0%, and B: more than or equal to 0.0005%, and less than or equal to 0.01%.

3. The steel sheet for carburizing according to claim 1, further comprising, in place of part of the balance Fe, one of, or two or more of, in mass%, Sn: less than or equal to1.0%, W: less than or equal to 1.0%, Ca: less than or equal to 0.01%, and REM: less than or equal to 0.3%.

4. A method for manufacturing the steel sheet for carburizing according to claim 1, the method comprising:

a hot-rolling step, in which a steel material having the chemical composition is heated, then rolled in a second last pass prior to hot finish rolling in a temperature range of 900° C. or higher and 980° C. or lower at a draft of 15% or larger and 25% or smaller, the hot finish rolling is terminated in a temperature range of 800° C. or higher and lower than 920° C. at a draft of 6% or larger, and the steel sheet is wound up at a temperature of 700° C. or lower; and an annealing step, in which the steel sheet obtained by the hot-rolling step, or the steel sheet cold-rolled subsequently to the hot-rolling step is heated in an atmosphere with nitrogen concentration controlled to less than 25% in volume fraction, at an average heating rate of 5° C/h or higher and 100° C/h or lower, up into a temperature range not higher than point $Ac_1$ defined by equation (1) below, annealed in a temperature range not higher than the point $Ac_1$ for 10 h or longer and 100 h or shorter, and then cooled at an average cooling rate of 5° C/h or higher and 100° C/h or lower in a temperature range from a temperature at the end of annealing down to 550° C., where in equation (1) below, notation [X] represents the content of element X (in mass %), which is substituted by zero if such element X is absent, $$Ac_1=750.8-26.6[C]+17.6[Si]-11.6[Mn]-22.9[Cu]-23[Ni]+24.1[Cr]+22.5[Mo]-39.7[V]-5.7[Ti]+232.4[Nb]-169.4[Al]-894.7[B] \quad \text{Equation (1).}$$

* * * * *